US007874885B2

(12) United States Patent
Matsueda et al.

(10) Patent No.: US 7,874,885 B2
(45) Date of Patent: Jan. 25, 2011

(54) ROWING BOAT FOOT SUPPORT ASSEMBLY

(75) Inventors: Keiji Matsueda, Yamaguchi (JP); Yasushi Nakamura, Hyogo (JP); Takuji Tatsumi, Osaka (JP)

(73) Assignee: Shimano Inc., Osaka (JP)

( * ) Notice: Subject to any disclaimer, the term of this patent is extended or adjusted under 35 U.S.C. 154(b) by 152 days.

(21) Appl. No.: 12/179,613

(22) Filed: Jul. 25, 2008

(65) Prior Publication Data

US 2010/0018450 A1 Jan. 28, 2010

(51) Int. Cl.
*B63H 16/00* (2006.01)

(52) U.S. Cl. ..... 440/104; 114/363

(58) Field of Classification Search ..... 114/159, 114/343, 347, 363; 440/104–106; 280/11.33
See application file for complete search history.

(56) References Cited

U.S. PATENT DOCUMENTS 3,528,672 A * 9/1970 Wunder ..... 280/612
5,367,976 A * 11/1994 Van Schaik ..... 114/347
6,270,090 B1 * 8/2001 Gignoux ..... 280/11.33
6,490,948 B2 * 12/2002 Tanaka ..... 74/594
7,552,695 B1 * 6/2009 Matsueda et al. ..... 114/363
2006/0183385 A1 8/2006 Kaufer
2006/0292940 A1 * 12/2006 Ewans ..... 440/104

FOREIGN PATENT DOCUMENTS

DE 93 09 887.1 U 8/1993

* cited by examiner

*Primary Examiner*—Stephen Avila
(74) *Attorney, Agent, or Firm*—Global IP Counselors, LLP

(57) ABSTRACT

A rowing boat foot support assembly is provided with a support member, a shoe attachment member and a release trigger mechanism. The support member is configured to be coupled to a rowing boat. The shoe attachment member is pivotally supported on the support member. The shoe attachment member includes a base portion and a movable fixing portion that is movably arranged with respect to the base portion between a shoe retaining position and a shoe releasing position. The release trigger mechanism is provided between the support member and the movable fixing portion to move the movable fixing portion from the shoe retaining position to the shoe releasing position.

35 Claims, 32 Drawing Sheets

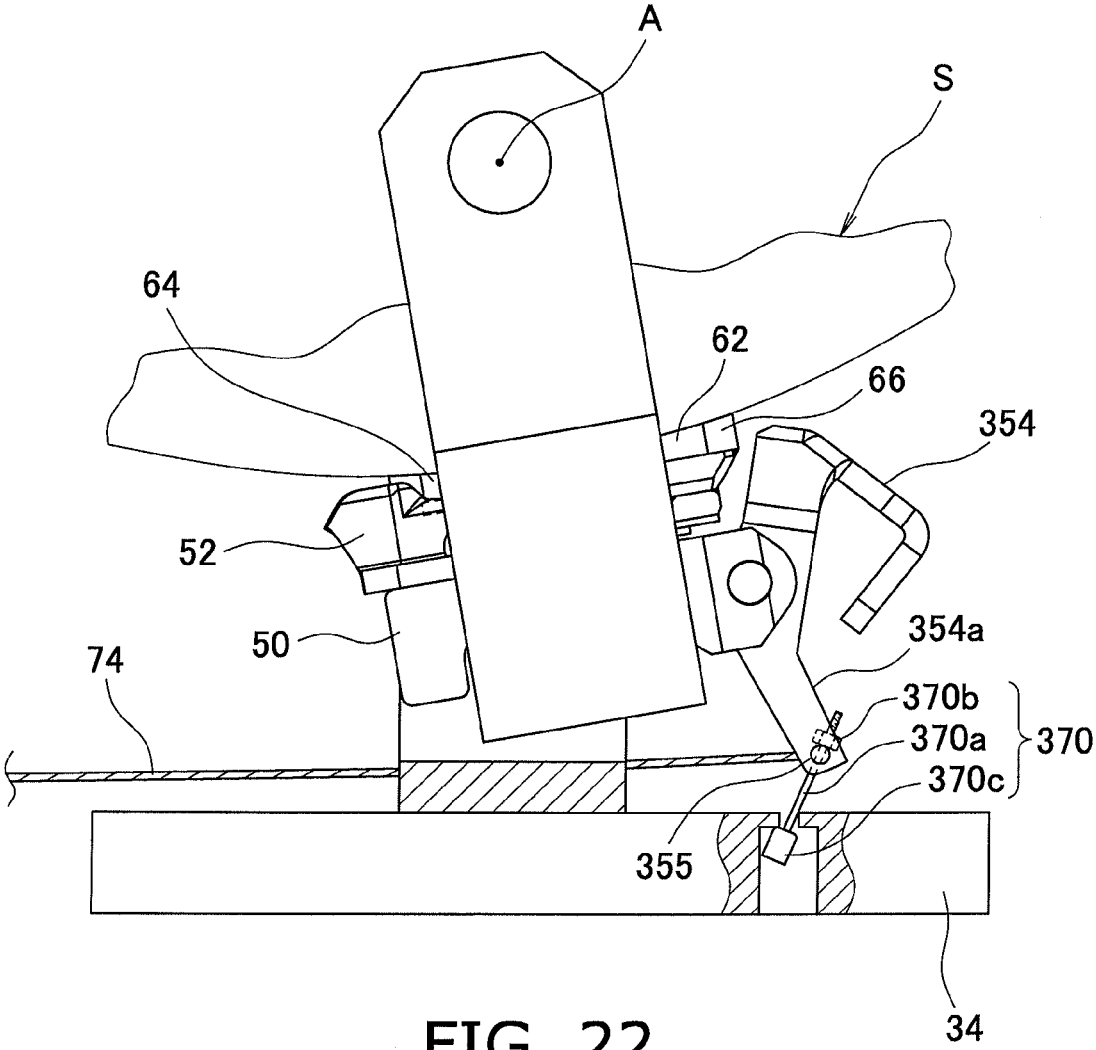
FIG. 22
FIG. 23
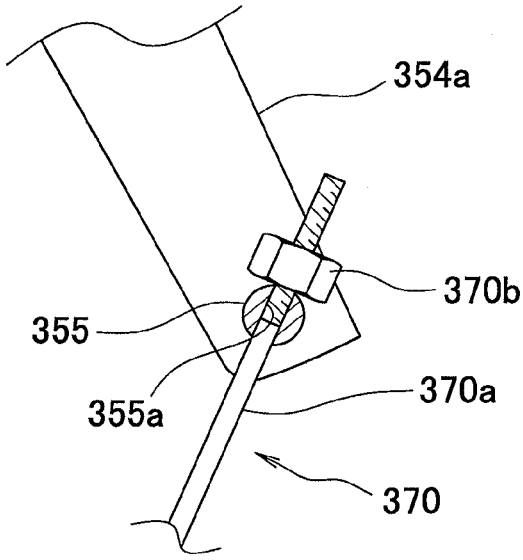

ROWING BOAT FOOT SUPPORT ASSEMBLY

BACKGROUND OF THE INVENTION

1. Field of the Invention

This present invention generally relates to a rowing boat foot support assembly. More specifically, the present invention relates to a rowing boat foot support assembly that includes a shoe attachment member for securing a rower's shoe to a foot rest.

2. Background Information

Rowing is becoming an increasingly more popular form of recreation. Moreover, rowing has become a very popular competitive sport for both amateurs and professionals. Whether rowing is for recreation or competition, the rowing industry is constantly improving the various components of rowing boats and equipment used by rowing enthusiasts. One component that has been extensively redesigned is the rowing boat footrest.

Traditionally, the footrest in a rowboat is an angled surface upon which a rower can brace his or her feet to provide increased power during the rowing process. Recently, footrests have been provided with simple shoe retaining straps or retaining mechanisms that hold a rower's shoe against the surface of the footrest. While these footrests work well, they have various drawbacks. For example, some of the shoe retaining mechanisms are not easily attached to and/or released from the rower's shoe.

In view of the above, it will be apparent to those skilled in the art from this disclosure that there exists a need for an improved rowing boat foot support assembly that allows for easily attached to and/or released from the rower's shoe. This invention addresses this need in the art as well as other needs, which will become apparent to those skilled in the art from this disclosure.

SUMMARY OF THE INVENTION

One object of the present invention is to provide a rowing boat foot support assembly that allows for the rower's shoe to be the easily attached to and/or released from a shoe attachment member (e.g., a shoe retaining mechanism).

In accordance with one aspect, a rowing boat foot support assembly is provided that basically comprises a support member, a shoe attachment member and a release trigger mechanism. The support member is configured to be coupled to a rowing boat. The shoe attachment member is pivotally supported on the support member. The shoe attachment member includes a base portion and a movable fixing portion that is movably arranged with respect to the base portion between a shoe retaining position and a shoe releasing position. The release trigger mechanism is provided between the support member and the movable fixing portion to move the movable fixing portion from the shoe retaining position to the shoe releasing position.

In accordance with another aspect, a rowing boat foot support assembly is provided that basically comprises a support member, a shoe attachment member and a float member. The support member is configured to be coupled to a rowing boat. The shoe attachment member is supported on the support member. The shoe attachment member includes a base portion, a movably front fixing portion and a movably rear fixing portion. The front fixing portion is movably with respect to the base portion between a shoe retaining position and a shoe insertion position. The rear shoe fixing portion is movably with respect to the base portion between a shoe retaining position and a shoe releasing position.

In accordance with yet another aspect, a rowing boat foot support assembly is provided that basically comprises a support member, a shoe attachment member and a float member. The support member is configured to be coupled to a rowing boat. The shoe attachment member is supported on the support member. The shoe attachment member includes a base portion and a movable fixing portion that is movably arranged with respect to the base portion between a shoe retaining position and a shoe releasing position. The float member is operatively coupled to the movable fixing portion by a connecting member that is arranged to move the movable fixing portion from the shoe retaining position to the shoe releasing position.

These and other objects, features, aspects and advantages of the present invention will become apparent to those skilled in the art from the following detailed description, which, taken in conjunction with the annexed drawings, discloses preferred embodiments.

BRIEF DESCRIPTION OF THE DRAWINGS

Referring now to the attached drawings which form a part of this original disclosure:

FIG. 22 is an enlarged side view of the shoe attachment member illustrated in FIG. 21, with the shoe attachment member pivoted outside of the normal rowing range so that the rear fixing portion is moved to a shoe releasing position;

FIG. 23 is an enlarged side view of the attachment of the rod to the rear fixing portion for the shoe attachment member illustrated in FIGS. 21 and 22;

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
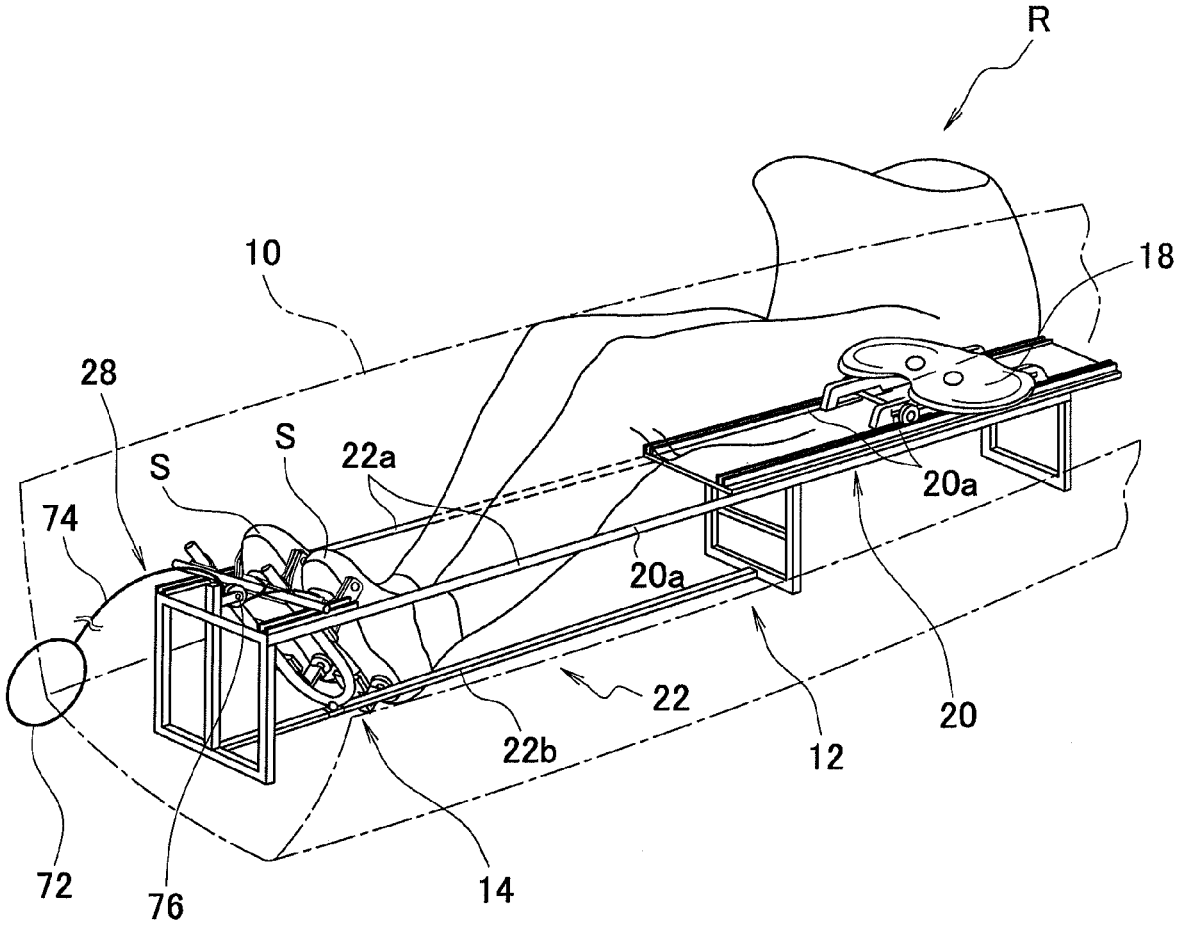
FIG. 1 is a perspective view showing a portion of a rowing boat equipped with a rower supporting structure having a rowing boat foot support assembly in accordance with a first embodiment.

Referring initially to FIG. 1, a rowing boat 10 is partially illustrated that includes a rower supporting structure 12 having a rowing boat foot support assembly 14 in accordance with a first embodiment. Only a portion of the rowing boat 10 is depicted in FIG. 1. The rowing boat 10 can be any of a variety of boat where one or more persons is seated for rowing the boat. For example, the rowing boat 10 can be a sweep-oar rowing boat in which each rower has one oar held by both hand. Alternatively, the rowing boat 10 can be a sculling rowing boat where each rower has two oars, one oar held by each hand. The conventional oars of the rowing boat 10 are omitted for the sake of brevity and to provide greater clarity in the drawings. Thus, the rowing boat 10 can have any of a variety of conventional shapes and configurations depending upon the type of boat. More specifically, the size and shape of the rowing boat 10 can have any size and shape that can accommodate the foot support assembly 14.

Still referring to FIG. 1, the rower supporting structure 12 is mounted within the interior of the rowing boat 10. In the illustrated embodiment, the rower supporting structure 12 is a relatively conventional structure that is rigidly fixed to or rigidly supported on the interior or gunwale portion of the rowing boat 10. The rower supporting structure 12 is a rigid frame with a seat 18 slidably mounted to a front end of the rower supporting structure 12 and the foot support assembly 14 mounted to a rear end of the rower supporting structure 12. While the seat support portion 20 and the foot support portion 22 are illustrated as being connected together as a single structure, it should be understood from the drawings and the description herein that the rower supporting structure 12 can also be formed of two or more separate structures that are supported on or rigidly fixed to the rowing boat 10. Since the supporting structure 12 is a relatively conventional structure, the supporting structure 12 will only be briefly discussed and illustrated herein.

Basically, the seat support portion 20 includes a pair of parallel rails 20*a* disposed on either side of the rowing boat 10 that support the seat 18. The seat 18 includes bearing portions such as rolling wheels or bushing surfaces that allow the seat 18 to slide smoothly in a longitudinal direction of the rowing boat 10 along the parallel rails 20*a*.

Basically, the foot support portion 22 includes a pair of upper rails 22*a* and a lower rail 22*b*. Preferably, the upper rails 22*a* are each arranged parallel to one another along the side of the rowing boat 10. The lower rail 22*b* can be centered along the floor of the rowing boat 10, and arranged parallel to the upper rails 22*a*. In the depicted embodiment, the rail 22*b* is equidistant from the upper rails 22*a*, but is lower that the rails 22*a*.

Referring now to FIGS. 2-8, the rowing boat foot support assembly 14 will now be explained in more detail. The foot support assembly 14 basically includes a support member 24, a pair of shoe attachment members 26 and an auxiliary release mechanism 28. Basically, the support member 24 is fixedly attached to the foot support portion 22 for supporting the foot support assembly 14. The shoe attachment members 26 are mounted pivotally (swingably) supported on the support member 24 to pivot in a prescribed pivotal rowing range $\alpha$, which corresponds a normal rowing motion or stroke. As explained below, the auxiliary release mechanism 28 is operatively coupled to the shoe attachment members 26 for remotely releasing the shoes S of the rower R from the shoe attachment members 26.

Figure 2:
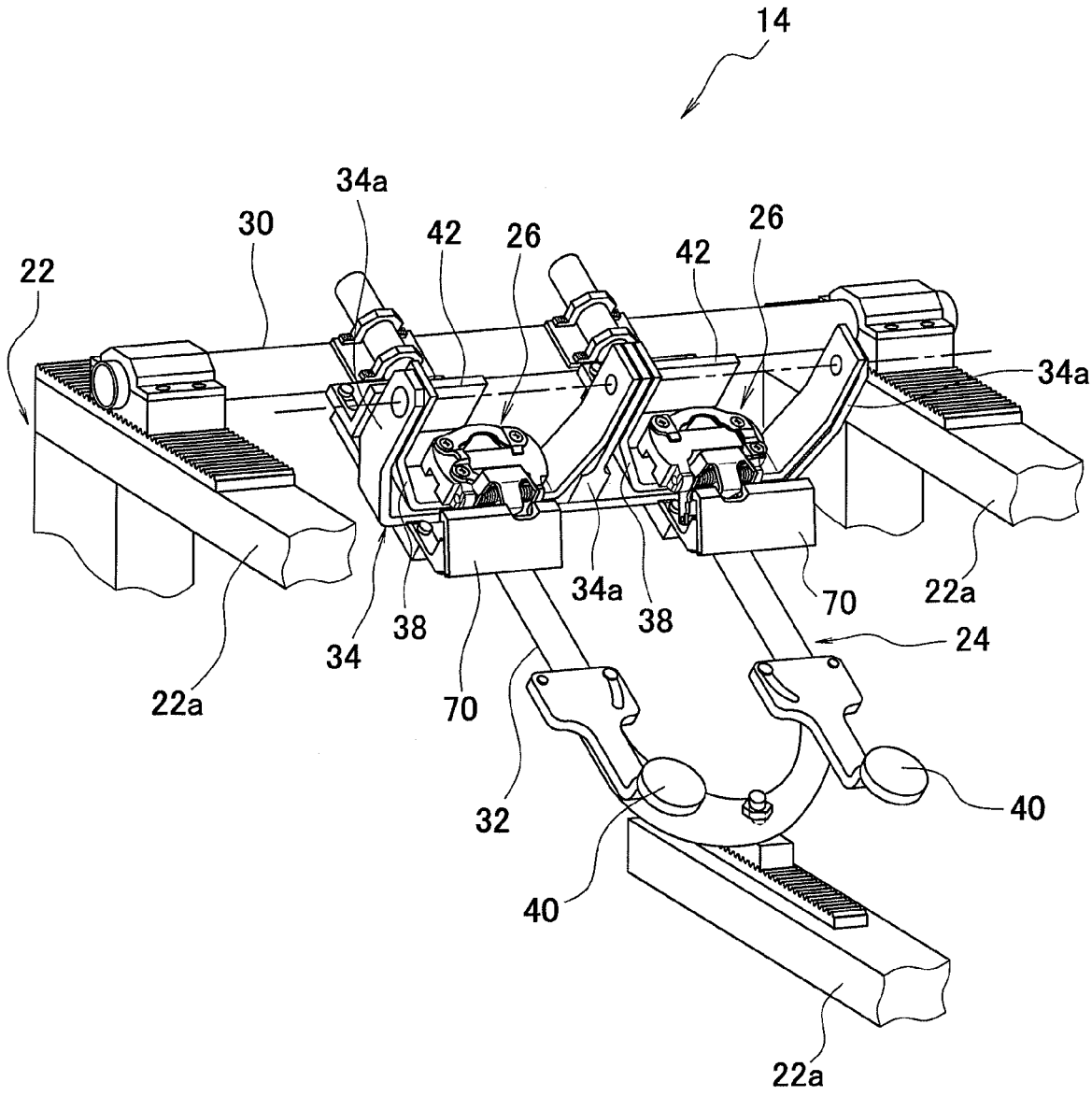
FIG. 2 is a perspective view of the foot support assembly of the first embodiment that is illustrated in FIG. 1.
Figure 3:
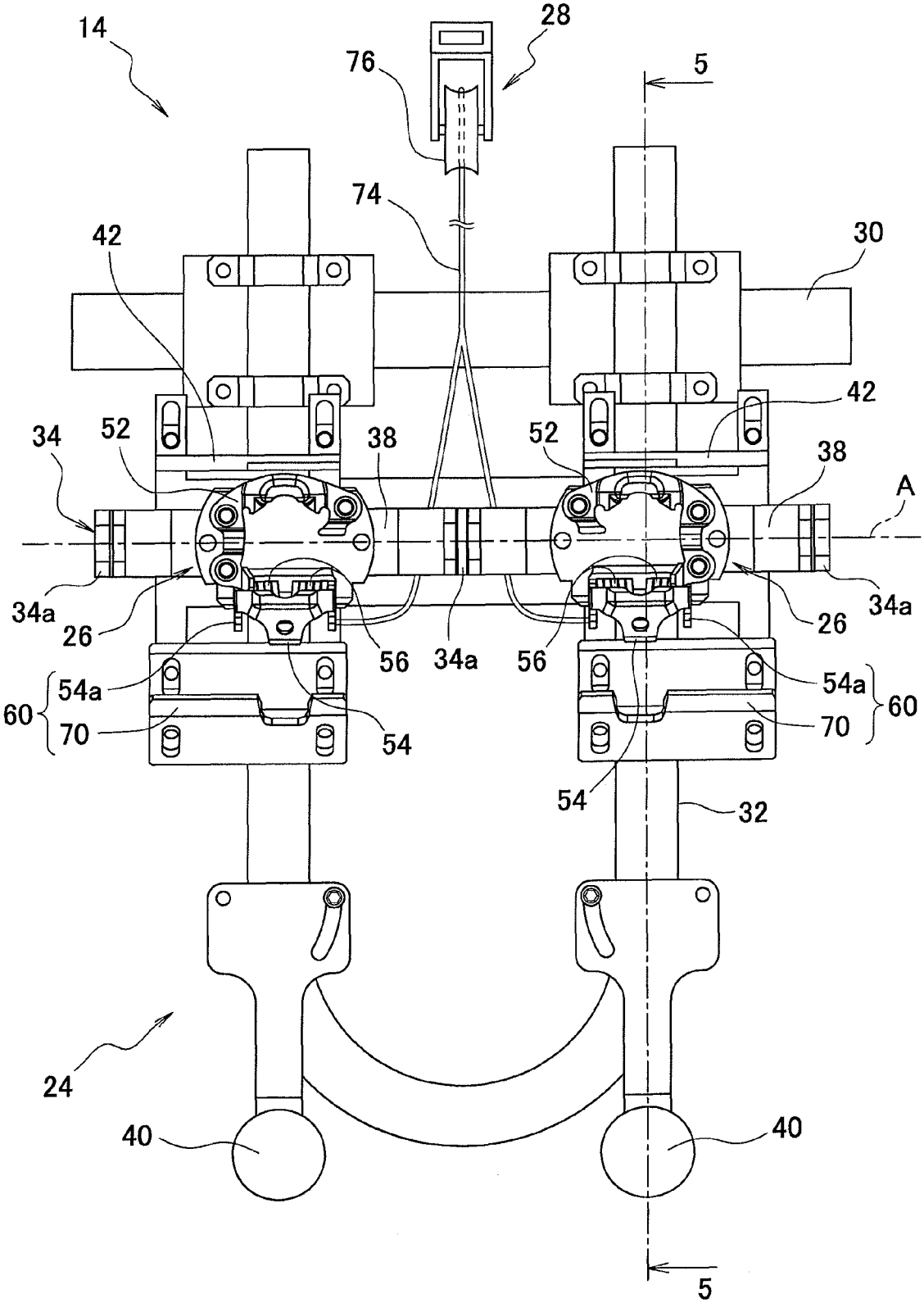
FIG. 3 is a top view of the foot support assembly of the first embodiment that is illustrated in FIGS. 1 and 2.
Figure 4:
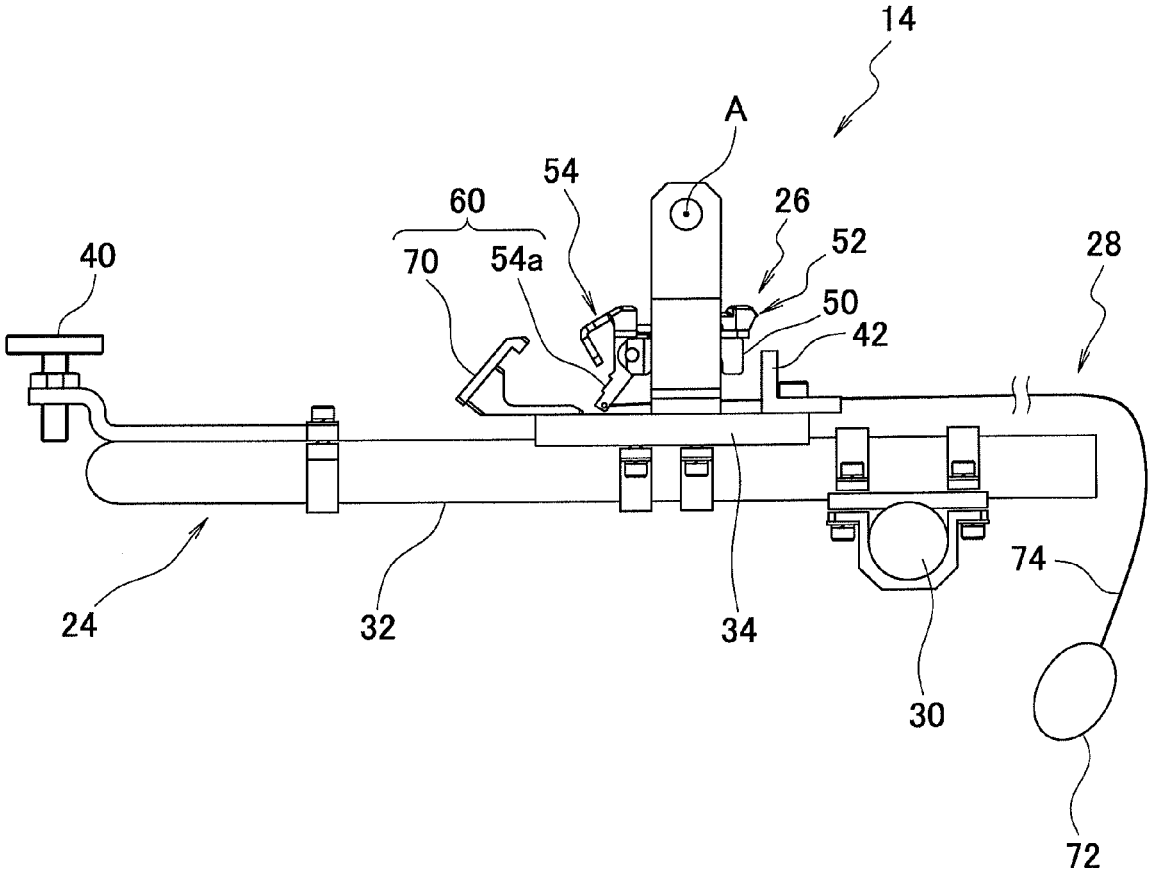
FIG. 4 is a side view of the foot support assembly of the first embodiment that is illustrated in FIGS. 1 to 3.
Figure 5:
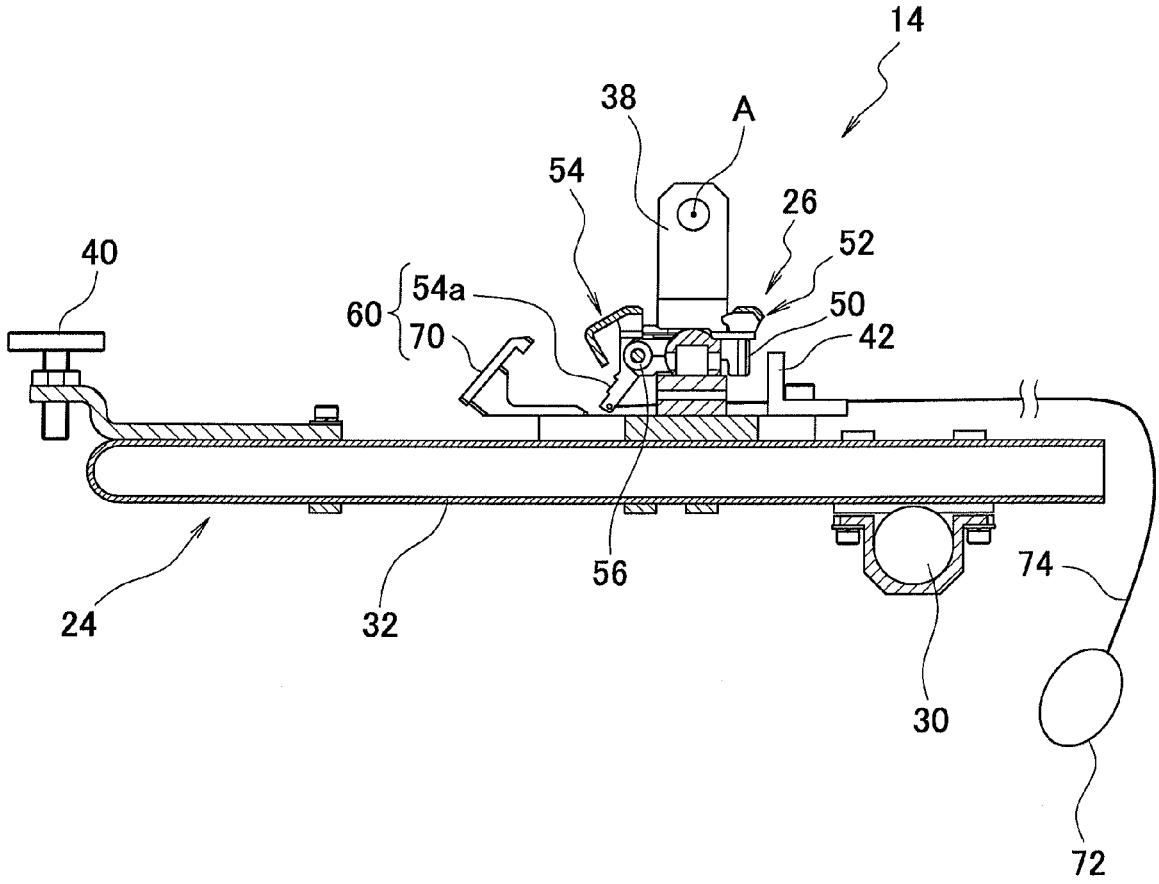
FIG. 5 is a cross sectional view of the foot support assembly of the first embodiment as seen along section line 5-5.

Turning to FIGS. 2 and 3, the support member 24 basically includes a lateral support bar 30, an inclined U-shaped support bar 32, a swing mounting frame 34 and a pair of U-shaped swinging footrests 38. The lateral support bar 30 extends laterally relative to the rowing boat 10 between the sides of the rowing boat 10. The lateral support bar 30 is adjustably attached to the upper rails 22*a* of the foot support portion 22. The U-shaped support bar 32 has an upper end attached to the lateral support bar 30 and a lower end adjustably attached to the lower rail 22*b*. The inclined support bar 32 further includes a pair of symmetrically arranged right and left side heel support members 40. The swing mounting frame 34 is mounted to a middle portion of the U-shaped support bar 32 to swingably support the U-shaped swinging footrests 38 above the U-shaped support bar 32. The swing mounting frame 34 has three supports 34*a* with the U-shaped swinging footrests 38 mounted to upper ends of the supports 34*a* of the swing mounting frame 34 to independently pivot about an axis A. One of the shoe attachment members 26 are mounted on each of the U-shaped swinging footrests 38.

Preferably, as seen in FIGS. 2 to 5, a forward motion limiting stop 42 is provided on the U-shaped support bar 32 for each of the U-shaped footrest members 38. The forward motion limiting stops 42 are positioned to limit forward movement of the U-shaped footrest members 38 when the rower R steps into the U-shaped footrest members 38. These forward motion limiting stops 42 make it easier for the shoes S to be secured to the shoe attachment members 26.

Figure 6:
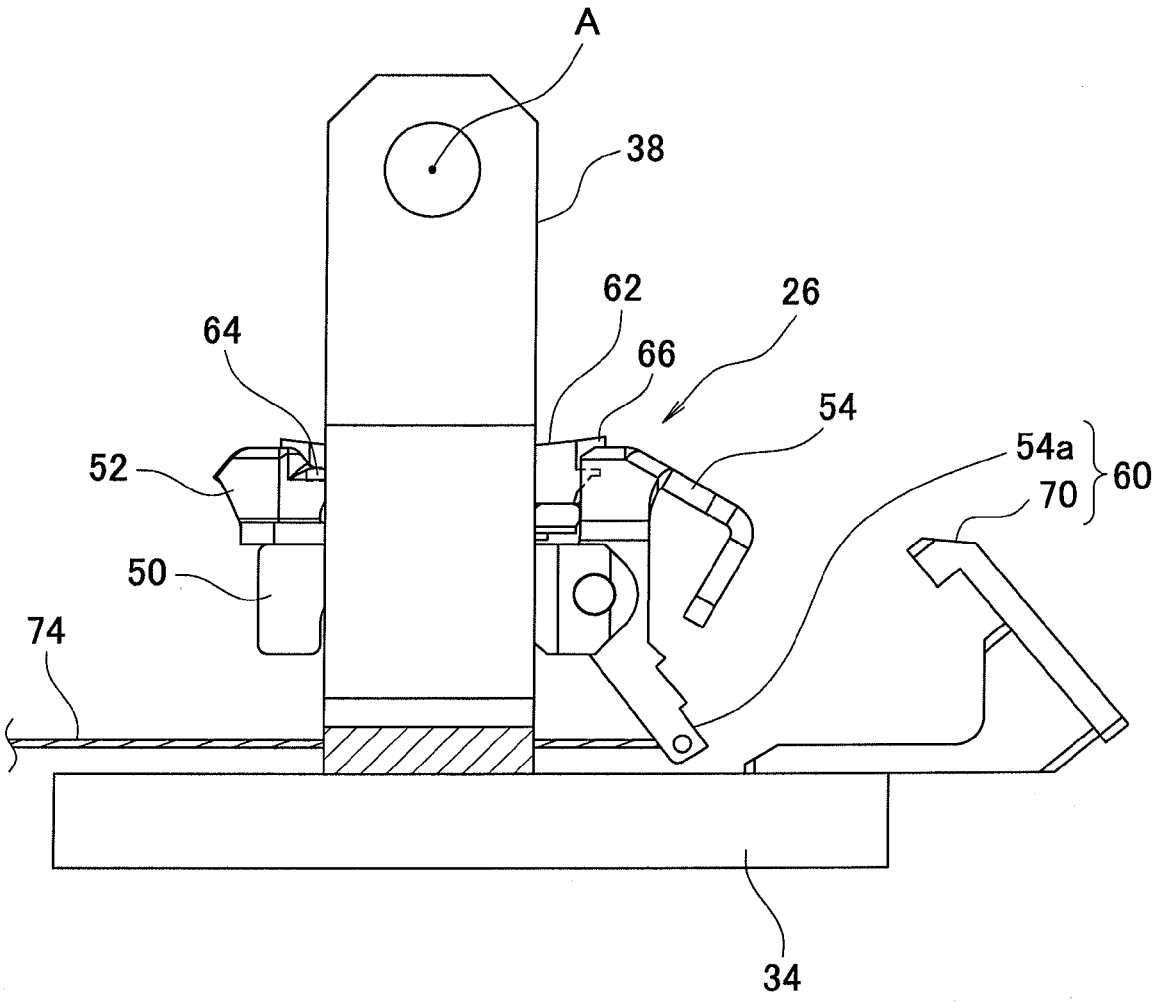
FIG. 6 is an enlarged side view of one of the shoe attachment members of the foot support assembly of the first embodiment that is illustrated in FIGS. 1 to 5 in the rest position.

As seen in FIG. 6, the U-shaped swinging footrests 38 are shown in the rest position in which forward movement is prevented by the forward motion limiting stops 42. Thus, this rest position corresponds to the position in which the U-shaped footrest member 38 aligns with the supports 34*a* of the swing mounting frame 34. Of course, the forward motion limiting stops 42 can be adjusted to allow for forward movement of the U-shaped swinging footrests 38 from the rest position of FIG. 6. However, for the sake of simplicity, the swinging movement of the U-shaped swinging footrests 38 as discussed herein, will assume that the rest position corresponds to the position in which the U-shaped footrest member 38 aligns with the supports 34*a* of the swing mounting frame 34.

The shoe attachment members 26 can basically be a conventional step-in type shoe attachment mechanism such as those used on bicycles so long as they have a movable fixing portion that is movably arranged with respect to the base portion between a shoe retaining position and a shoe releasing position. Specifically, each of the shoe attachment members 26 can be a step-in type shoe attachment mechanism, such as those disclosed in, for example, U.S. Pat. No. 6,119,551, U.S. Pat. No. 6,490,948, and U.S. Pat. No. 6,925,908. In fact, each of the shoe attachment members 26 of the first illustrated embodiment includes a base member or portion 50, a front clamping member 52, a rear clamping member 54 and a biasing member 56 in which the members 52, 54 and 56 are the same as those shown in U.S. Pat. No. 6,490,948, except that the rear clamping member 54 has been modified to include a part of a release trigger mechanism 60 as discussed below. Accordingly, the clamping members 52 and 54 constitute fixing portions of the shoe attachment member 26 with the rear clamping member 54 being a movable fixing portion in this embodiment. The front clamping member 52 is attached to the base member 50 in a non-movable manner, while the rear clamping member 54 is pivotally attached to the base member 50. The rear clamping member 54 (e.g., the movable fixing portion) is disposed rearward of the front clamping member 52 to define a shoe (cleat) receiving area therebetween. In this embodiment, the front clamping member 52 is non-movably with respect to the base member 50.

The biasing member 56 is preferably a pair of torsion springs that are disposed on a pivot axle that pivotally mounts the rear clamping member 54 to the base member 50. Each to the torsion springs of the biasing member 56 has one end operatively engaged with the base member 50 and the other end operatively engaged with the rear clamping member 54 to urge the rear clamping member 54 from the shoe releasing position to the shoe retaining position.

Moreover, each of the shoes S has a cleat or attachment member 62 that is fixed attached to the bottom sole portion of each of the shoes S. The cleats 62 for the shoe attachment members 26 of the first illustrated embodiment are identical to the ones shown in U.S. Pat. No. 6,490,948. The clamping members 52 and 54 engage the cleats 62 to secure the shoes S to the base member 50, which is fixedly secured to the U-shaped swinging footrests 38. More specifically, to secure one of the cleats 62 to one of the shoe attachment members 26, the rower R will insert a front end 64 of the one of the cleats 62 beneath the front clamping member 52 and then step down on the shoe attachment members 26 so that a rear end 66 of the cleat 62 will contact a forward edge of the rear clamping member 54 to pivot the rear clamping member 54 in a rearward direction against the biasing force of the biasing member 56. Once the rear end 66 of the cleat 62 passes over the forward edge of the rear clamping member 54 the biasing force of the biasing member 56 pivots the rear clamping member 54 in a forward direction to grip the rear end 66 of the cleat 62.

Figure 7:
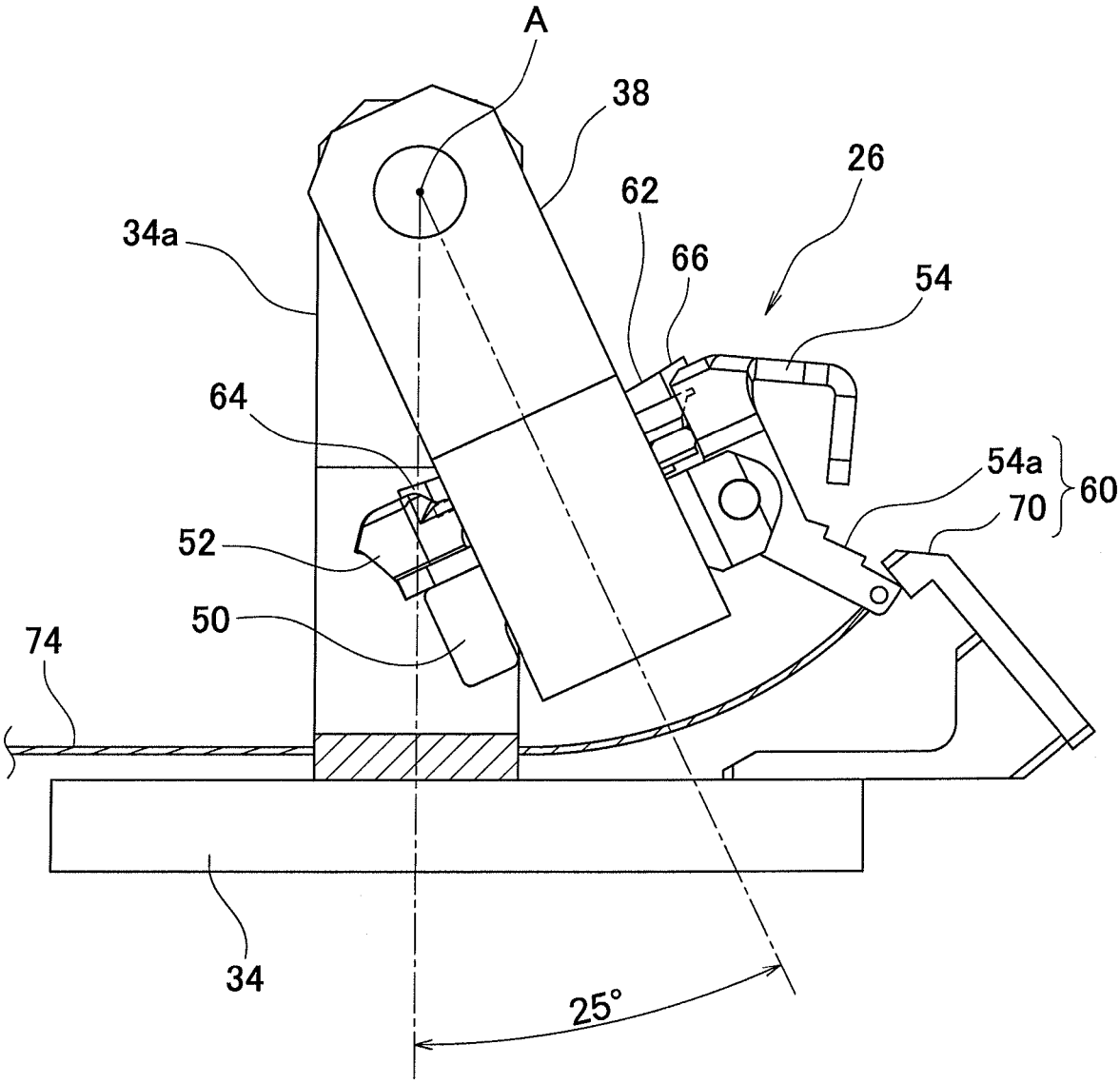
FIG. 7 is an enlarged side view of the shoe attachment member illustrated in FIG. 6, but with the shoe attachment member pivoted within the normal rowing range.
Figure 8:
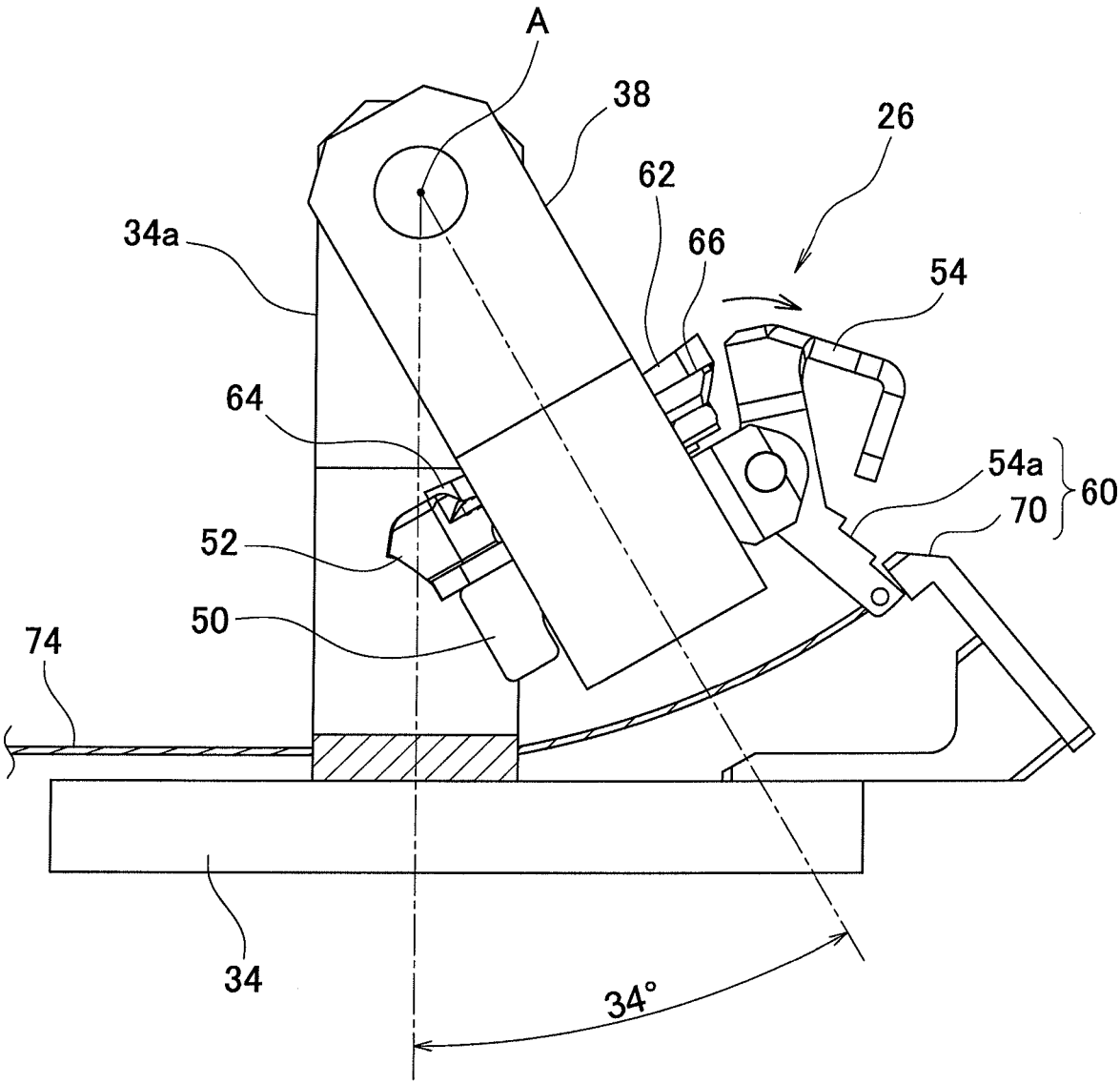
FIG. 8 is an enlarged side view of the shoe attachment member illustrated in FIGS. 6 and 7, but with the shoe attachment member pivoted outside of the normal rowing range so that the rear fixing portion is moved to a shoe releasing position.

As best seen in FIGS. 6 to 8, the release trigger mechanism 60 is formed between the swing mounting frame 34 of the support member 24 and the shoe attachment members 26 for releasing the cleats 62 of the shoes S from the shoe attachment members 26. In particular, each of the rear clamping members 54 (e.g., the movable fixing portion) is provided with a pair of projections 54*a* that form a first part of the release trigger mechanism 60. The swing mounting frame 34 of the support member 24 further includes a stopper 70 for each of the shoe attachment members 26 that form a second part of the release trigger mechanism 60.

The stoppers 70 are fixed to the support member 24 and the projections 54*a* are fixed to the rear clamping members 54 of the shoe attachment members 26, with a free space disposed between the stoppers 70 and the projections 54*a* while the shoe attachment members 26 are within the prescribed pivotal rowing range. The stoppers 70 and the projections 54*a* contact while the shoe attachment members 26 are in extended pivotal positions that are outside of a prescribed pivotal rowing range.

The stoppers 70 are preferably positioned on the inclined U-shaped support bar 32 to move the rear clamping member 54 (e.g., the movable fixing portion) from the shoe retaining position to the shoe releasing position in response to pivotal movement of the shoe attachment members 26 outside of the prescribed pivotal rowing range. More specifically, the projections 54*a* of the rear clamping members 54 of the shoe attachment members 26 will engage the stoppers 70 for releasing the cleats 62 of the shoes S when the shoe attachment members 26 are pivoted outside of the prescribed pivotal rowing range. In the illustrated embodiment, as seen in FIG. 7, the U-shaped swinging footrests 38 with the shoe attachment members 26 attached thereto can pivot twenty-five degrees rearward from the rest position of FIG. 6 without releasing. However, if the U-shaped swinging footrests 38 are swung more than twenty-five degrees rearward from the rest position of FIG. 6, then the projections 54*a* of the rear clamping members 54 of the shoe attachment members 26 will engage the stoppers 70. Thus, movement of the U-shaped swinging footrests 38 past twenty-five degrees rearward from the rest position of FIG. 6 results in the rear clamping members 54 being pivoted from the shoe retaining position (FIGS. 6 and 7) to the shoe releasing position (FIG. 8) when the U-shaped swinging footrests 38 are swung thirty-four degrees.

Figure 9:
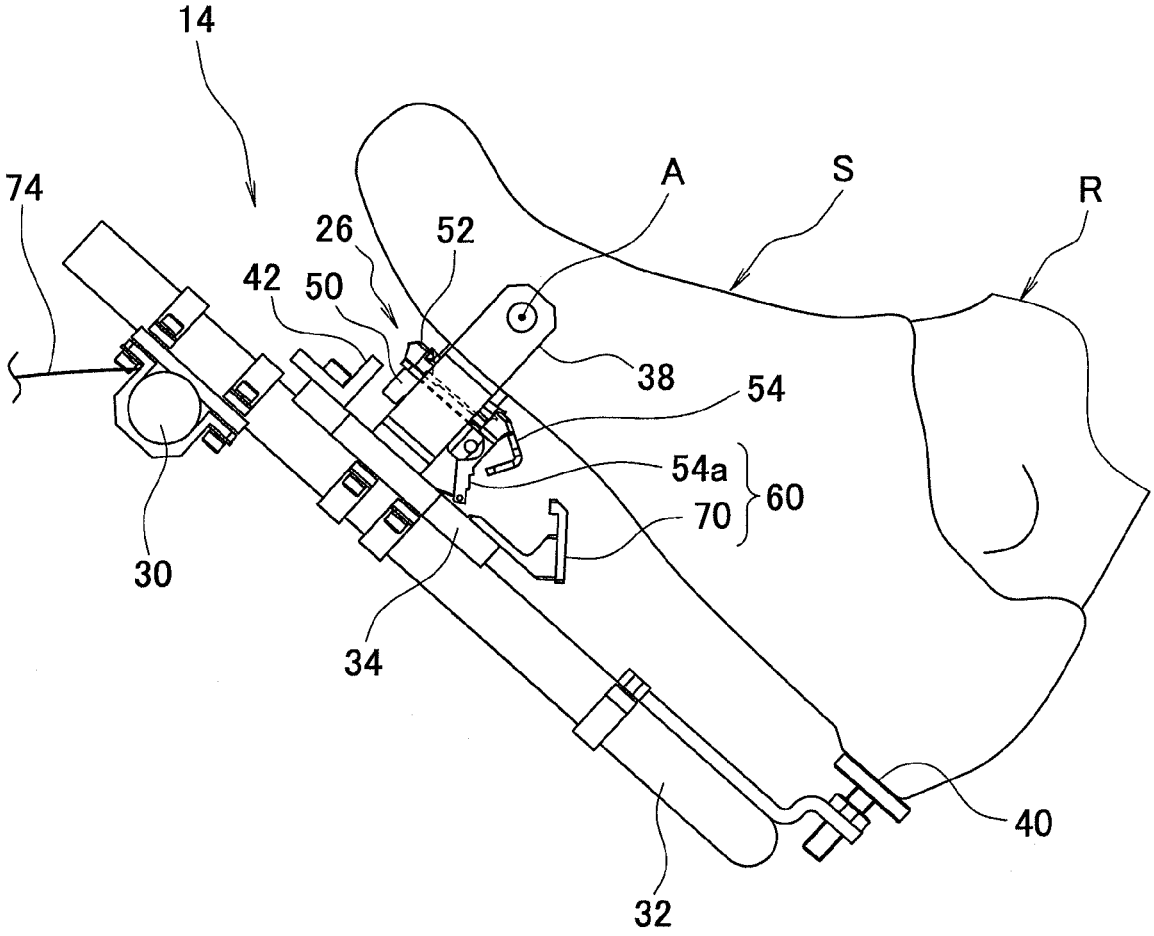
FIG. 9 is a side view of the foot support assembly of the first embodiment with the shoe attachment member in the rest position.
Figure 10:
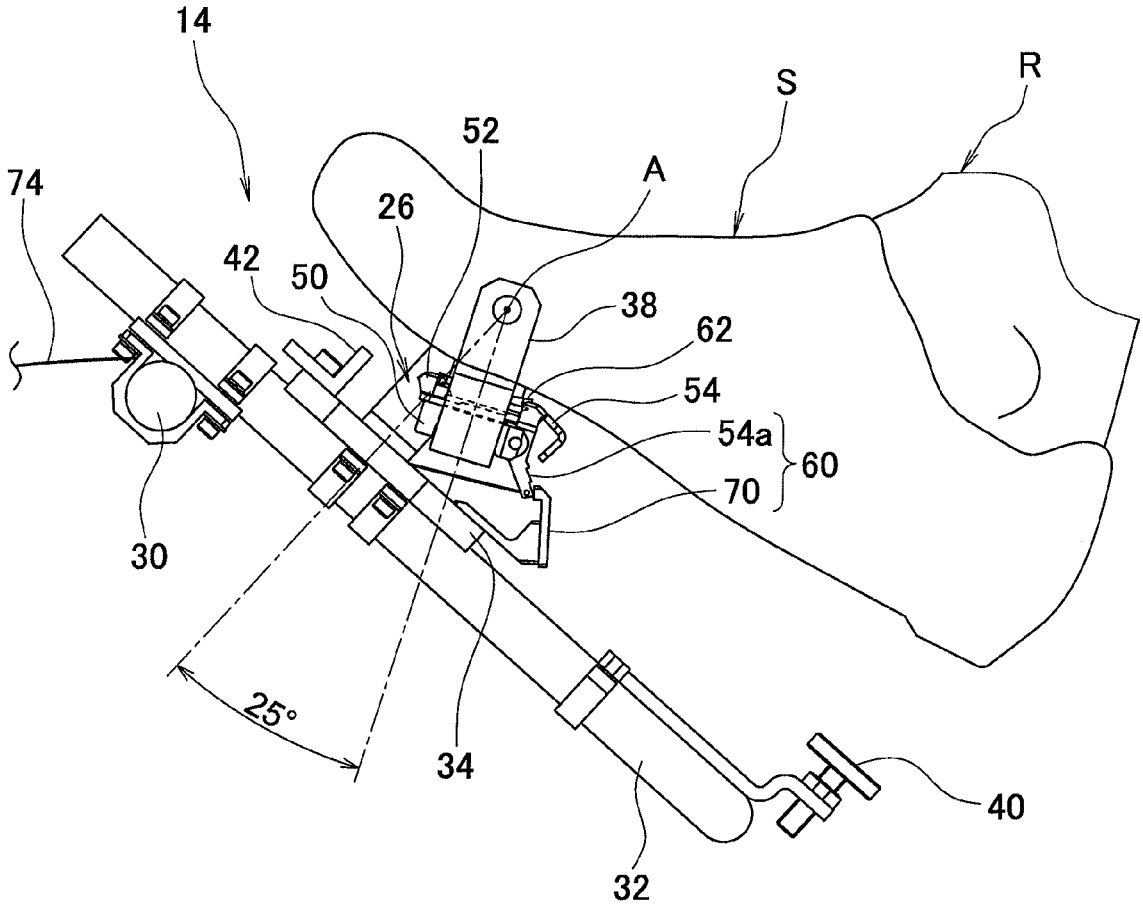
FIG. 10 is a side view of the foot support assembly illustrated in FIG. 9, but with the shoe attachment member pivoted within the normal rowing range.
Figure 11:
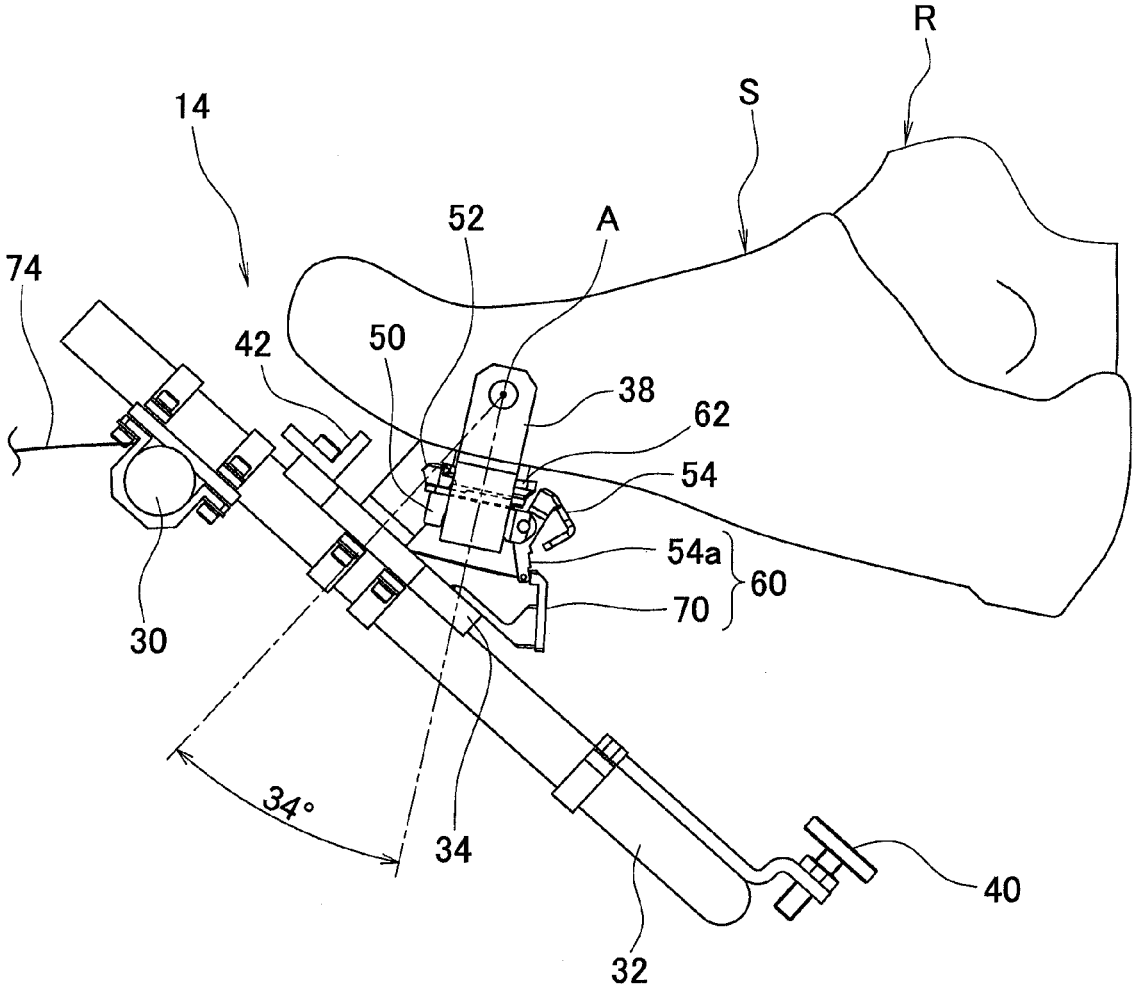
FIG. 11 is a side view of the foot support assembly illustrated in FIGS. 9 and 10, but with the shoe attachment member pivoted outside of the normal rowing range so that the rear fixing portion is moved to a shoe releasing position.
Figure 12:
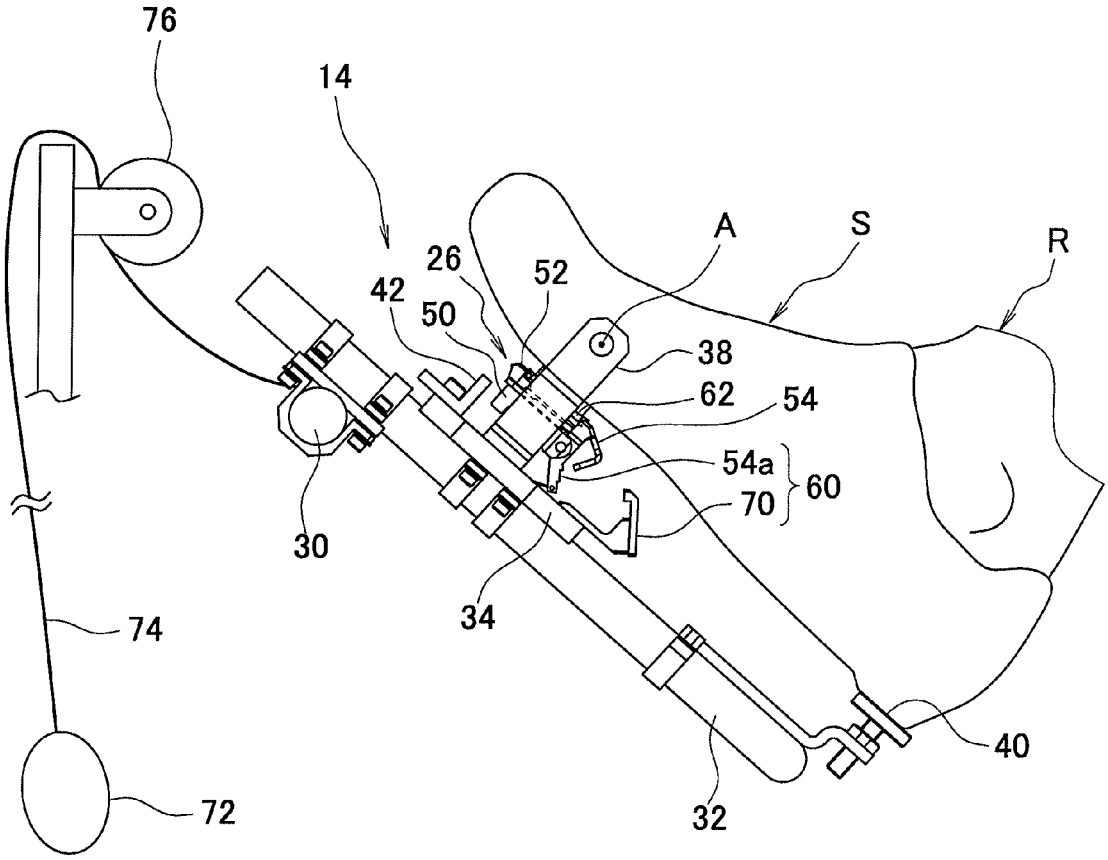
FIG. 12 is a side view of the foot support assembly of the first embodiment with the float coupled to the shoe attachment member which is in the rest position.
Figure 13:
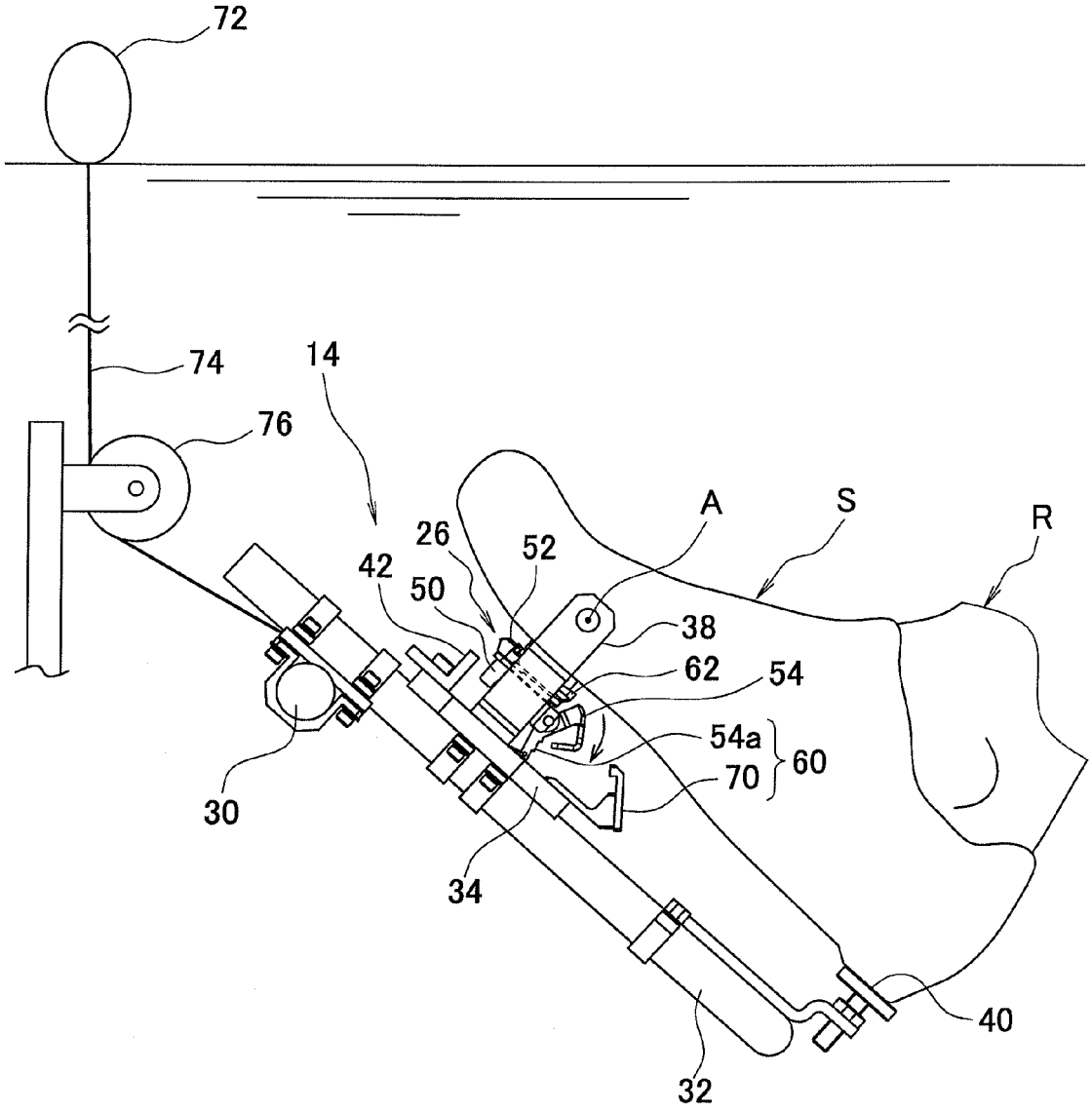
FIG. 13 is a side view of the foot support assembly of the first embodiment with the float coupled to the shoe attachment member which is in the shoe releasing position due to a pulling force on the float.

Accordingly, the prescribed pivotal rowing range in this embodiment is twenty-five degrees, which corresponds a normal range of motion for the U-shaped swinging footrests 38 when the rower is performing a normal rowing operation as seen in FIGS. 9 and 10. In other words, in order to begin a releasing operation, rower R must pivot the U-shaped swinging footrests 38 outside of the prescribed pivotal rowing range, which corresponds to the normal rowing operation with preferably a few extra degrees of swinging motion. This arrangement prevents the rower R from accidently releasing from shoe attachment members 26.

As seen in FIGS. 1, 3 to 5, 12 and 13, the auxiliary release mechanism 28 is attached to the rear clamping members 54 for remotely moving the rear clamping members 54 from pivoted from the shoe retaining position (FIG. 12) to the shoe releasing position (FIG. 13) without the U-shaped swinging footrests 38 being swung outside of the prescribed pivotal rowing range. In particular, the auxiliary release mechanism 28 includes a float 72, a tether 74 (e.g. a connecting member) and a guide pulley 76. The tether 74 couples the float 72 to the rear clamping members 54. The guide pulley 76 is fixed to the supporting structure 12 for guiding the tether 74. Thus, if the rowing boat 10 should happen to be submersed in water, the float 72 will float in the water so that a rescuer can pull on the float 72, which will result in the tether 74 rotating the rear clamping member 54 (e.g., the movable fixing portion) from the shoe retaining position to the shoe releasing position in response to pulling force on the float 72. One of the projections 54 of each of the rear clamping members 54 has a hole 54*b* in which the tether 74 is secured. In this embodiment, the tether 74 has a Y-shaped configuration so that a single tether can be used to operate both of the rear clamping members 54 at once. Of course, two connecting members or tethers can be provided so that each of the rear clamping members 54 is independently operated.

In any event, the connecting member or tether 74 is connected between at least one of the rear clamping members 54 and the float member 72 so that a pulling movement of the float member 72 with respect to the rear clamping member 54 causes the rear clamping member 54 to move from the shoe retaining position to the shoe releasing position in response to a pulling movement of the float member 72 with respect to the rear clamping member 54.

Second Embodiment

Figure 14:
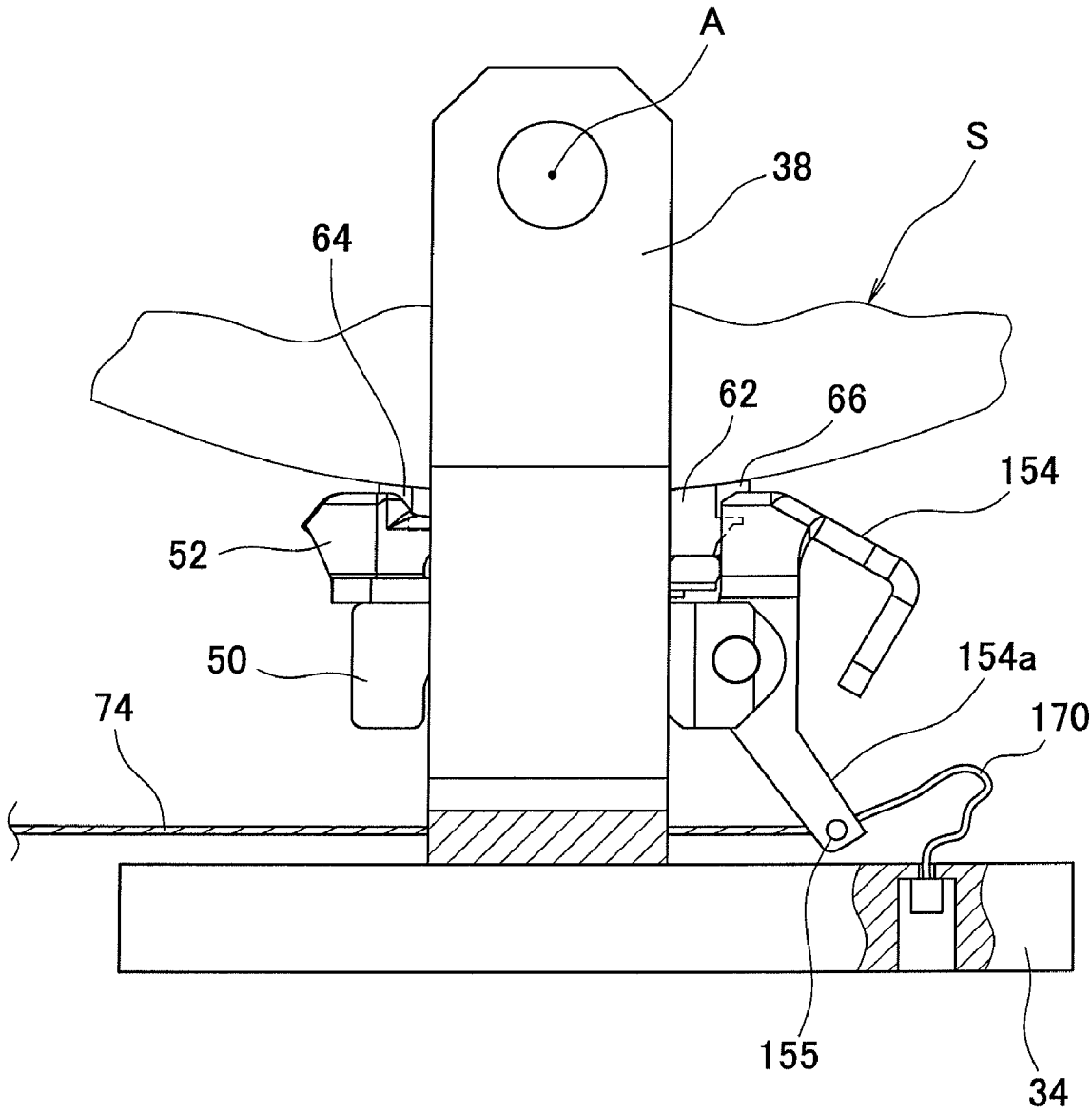
FIG. 14 is an enlarged side view of a shoe attachment member of a foot support assembly in accordance with a second embodiment, with the rear fixing portion in the rest position.
Figure 15:
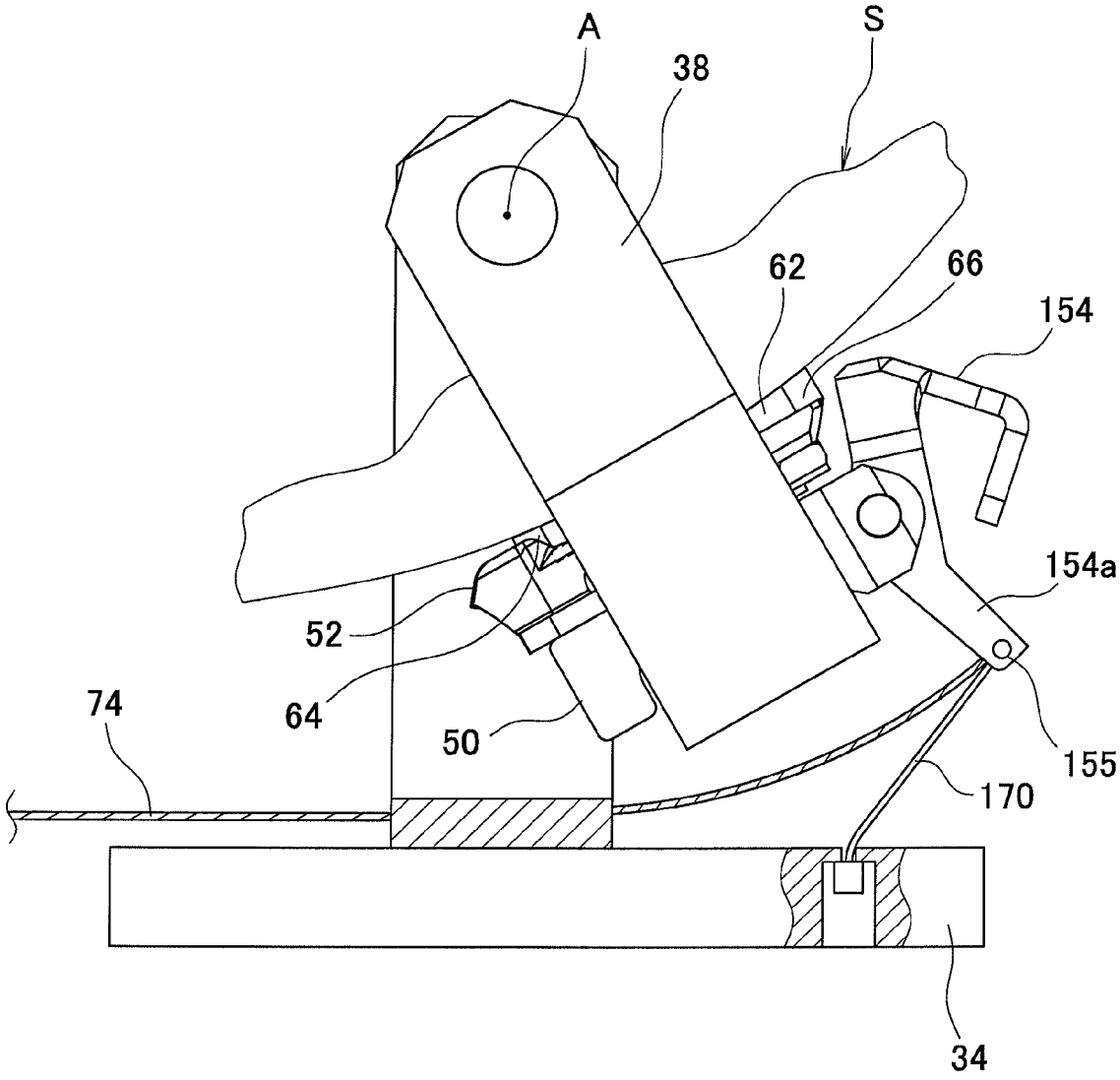
FIG. 15 is an enlarged side view of the shoe attachment member illustrated in FIG. 14, with the shoe attachment member pivoted outside of the normal rowing range so that the rear fixing portion is moved to a shoe releasing position.
Figure 16:
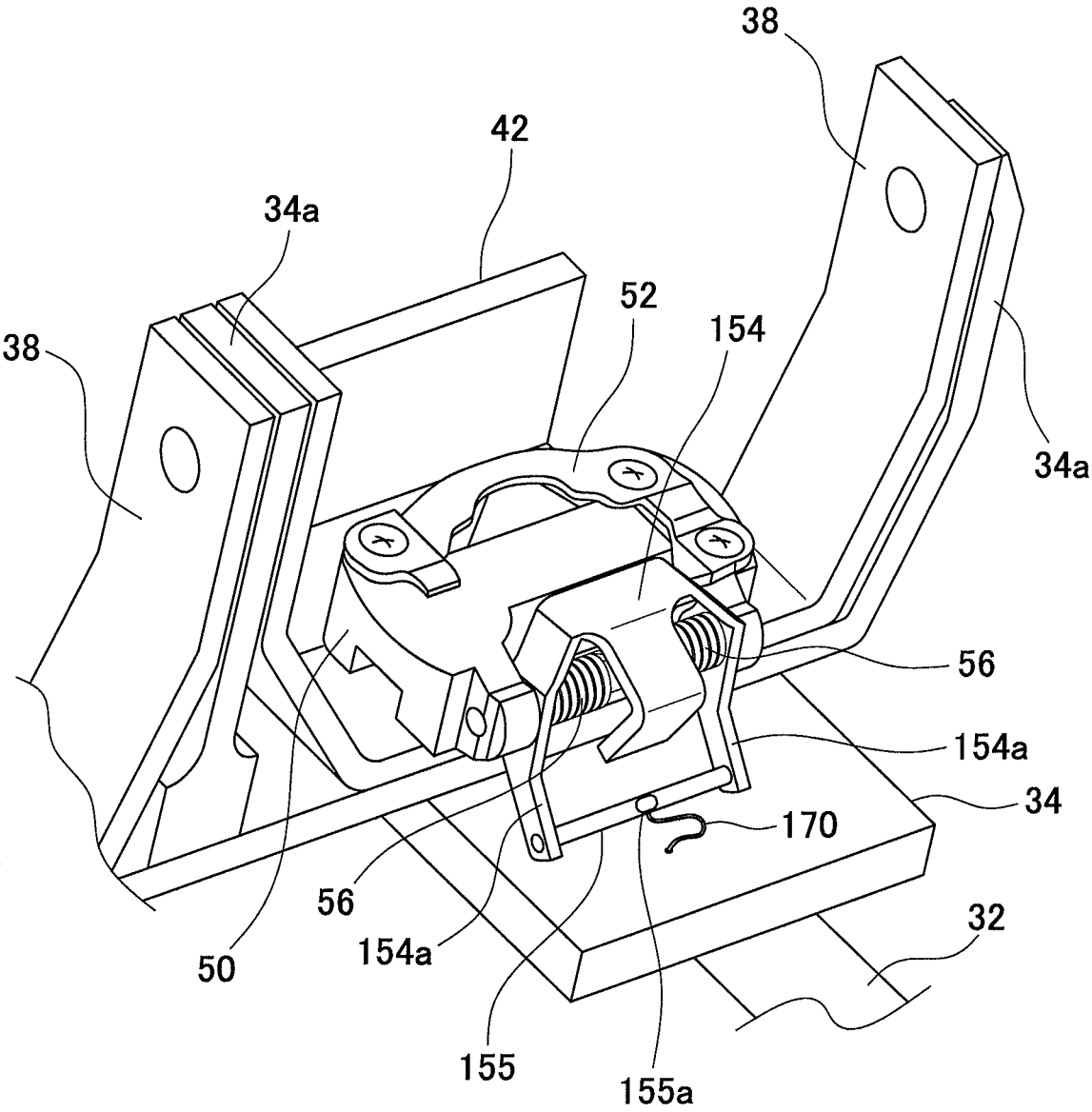
FIG. 16 is a rear perspective view of the shoe attachment member illustrated in FIGS. 14 and 15, with the rear fixing portion in the rest position.
Figure 17:
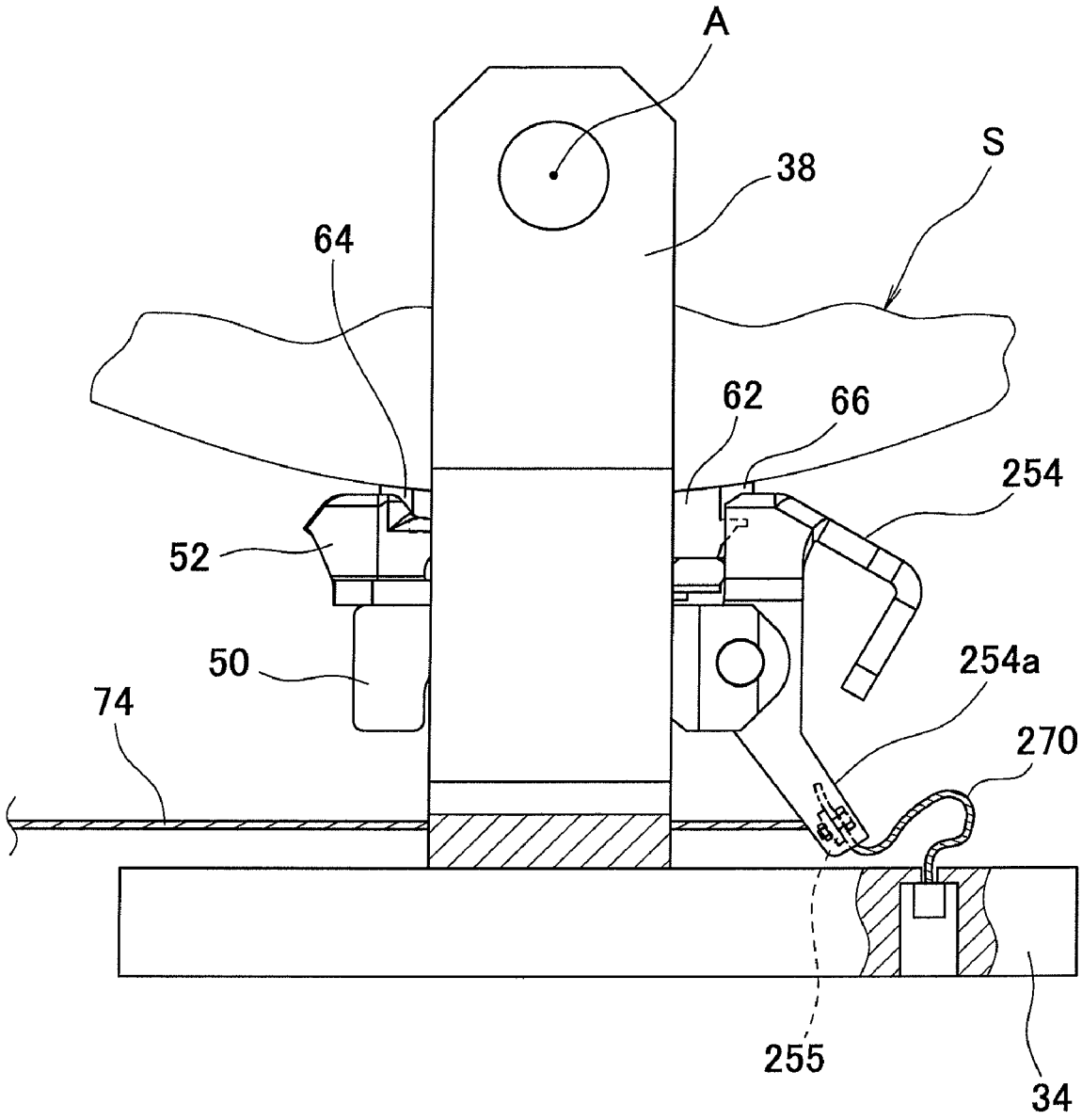
FIG. 17 is an enlarged side view of a shoe attachment member of a foot support assembly in accordance with a third embodiment, with the rear fixing portion in the rest position.
Figure 18:
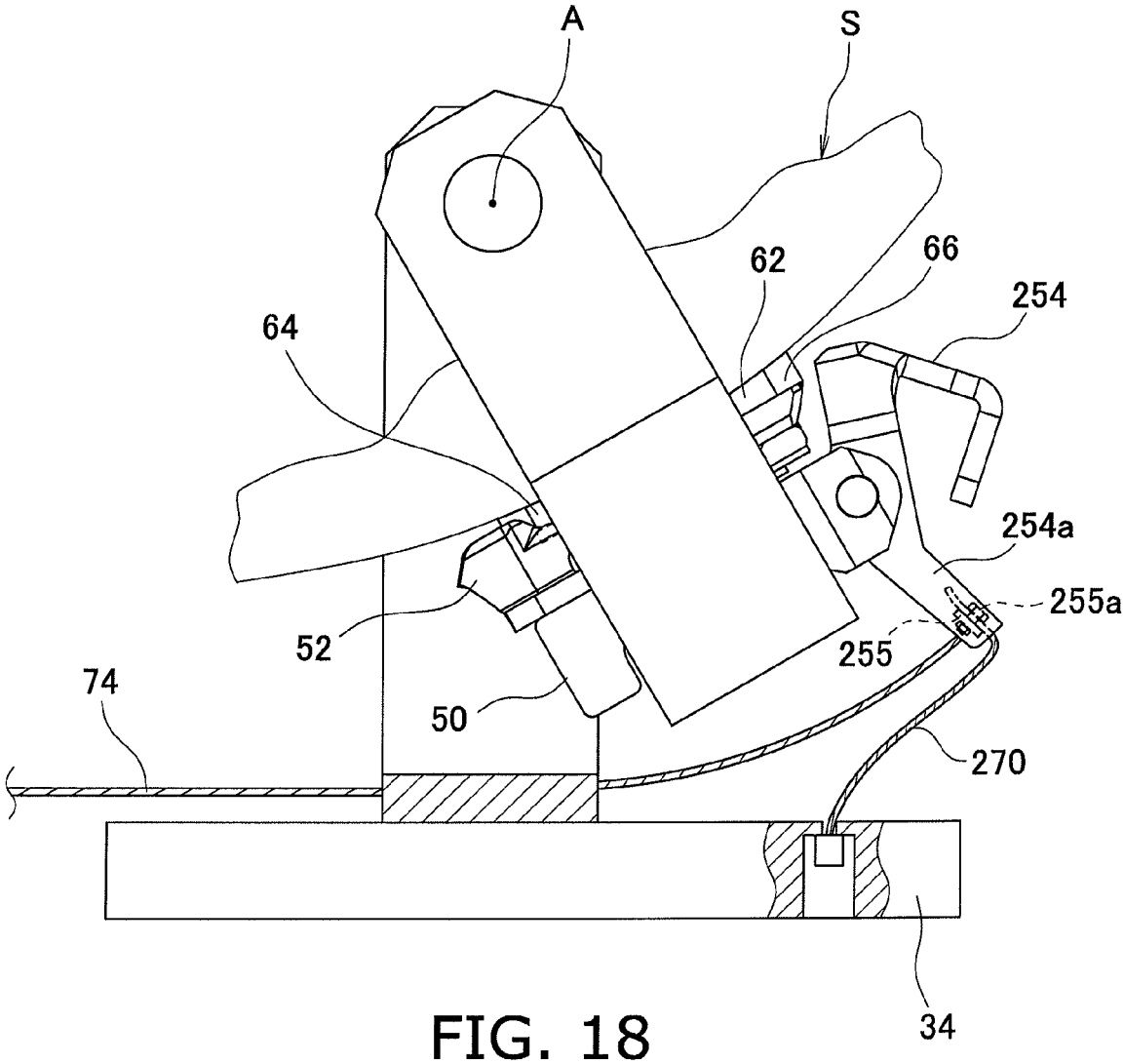
FIG. 18 is an enlarged side view of the shoe attachment member illustrated in FIG. 17, with the shoe attachment member pivoted outside of the normal rowing range so that the rear fixing portion is moved to a shoe releasing position.
Figure 19:
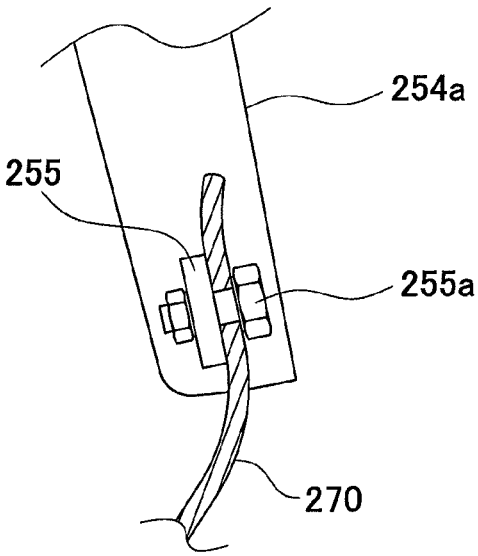
FIG. 19 is an enlarged side view of the attachment of the cable to the rear fixing portion for the shoe attachment member illustrated in FIGS. 17 and 18.
Figure 20:
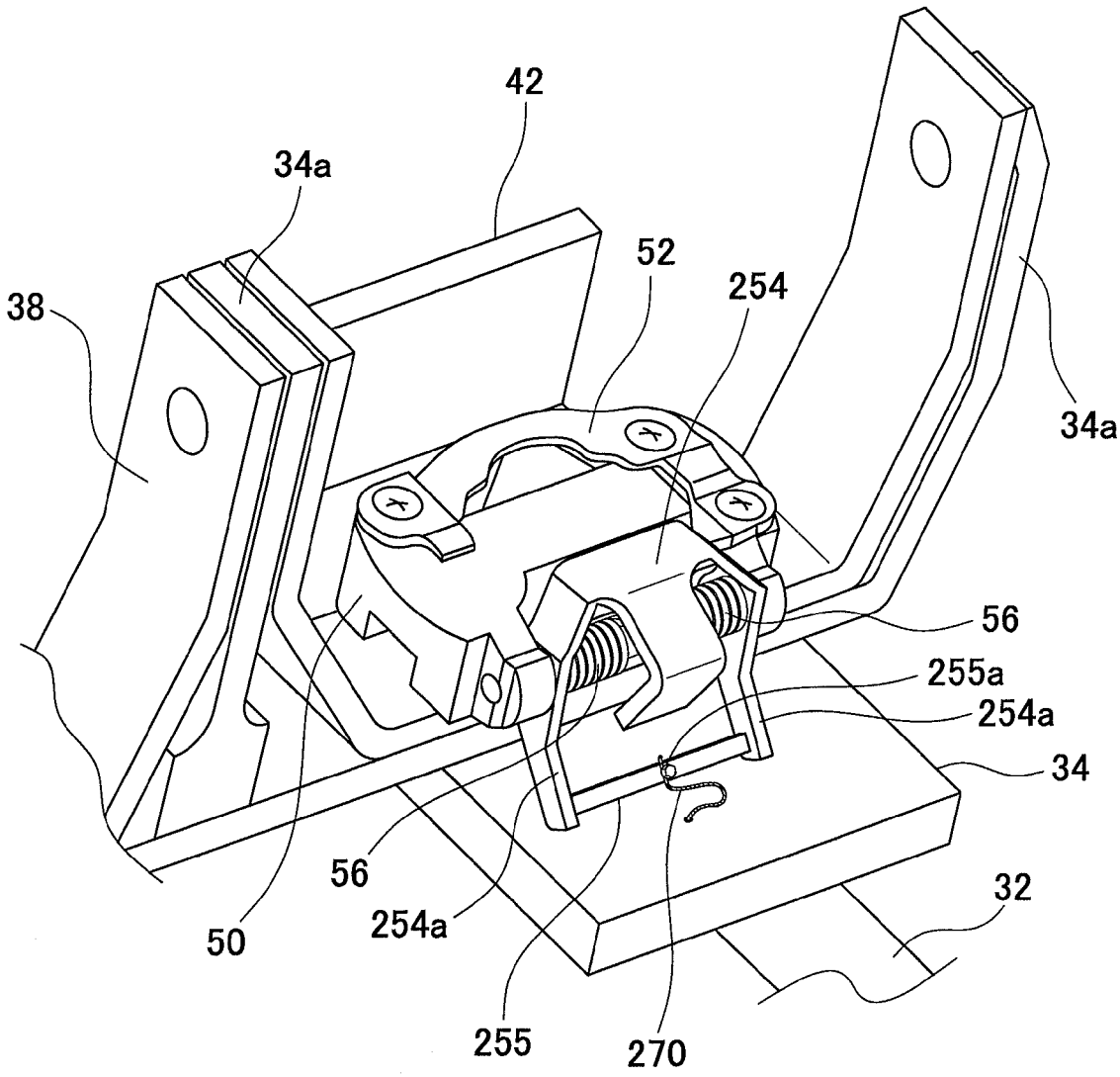
FIG. 20 is a rear perspective view of the shoe attachment member illustrated in FIGS. 17 and 18, with the rear fixing portion in the rest position.
Figure 21:
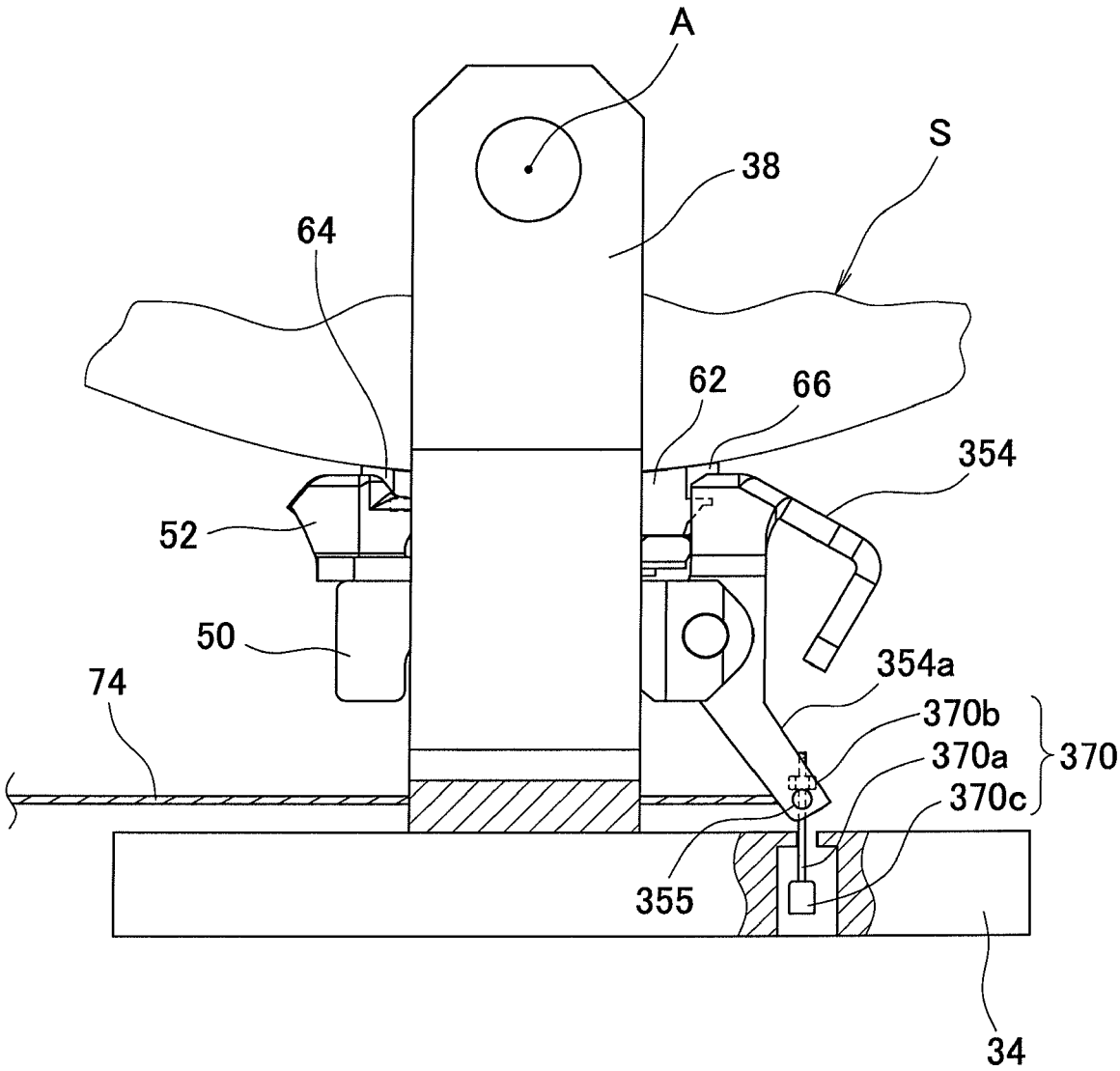
FIG. 21 is an enlarged side view of a shoe attachment member of a foot support assembly in accordance with a fourth embodiment, with the rear fixing portion in the rest position.
Figure 24:
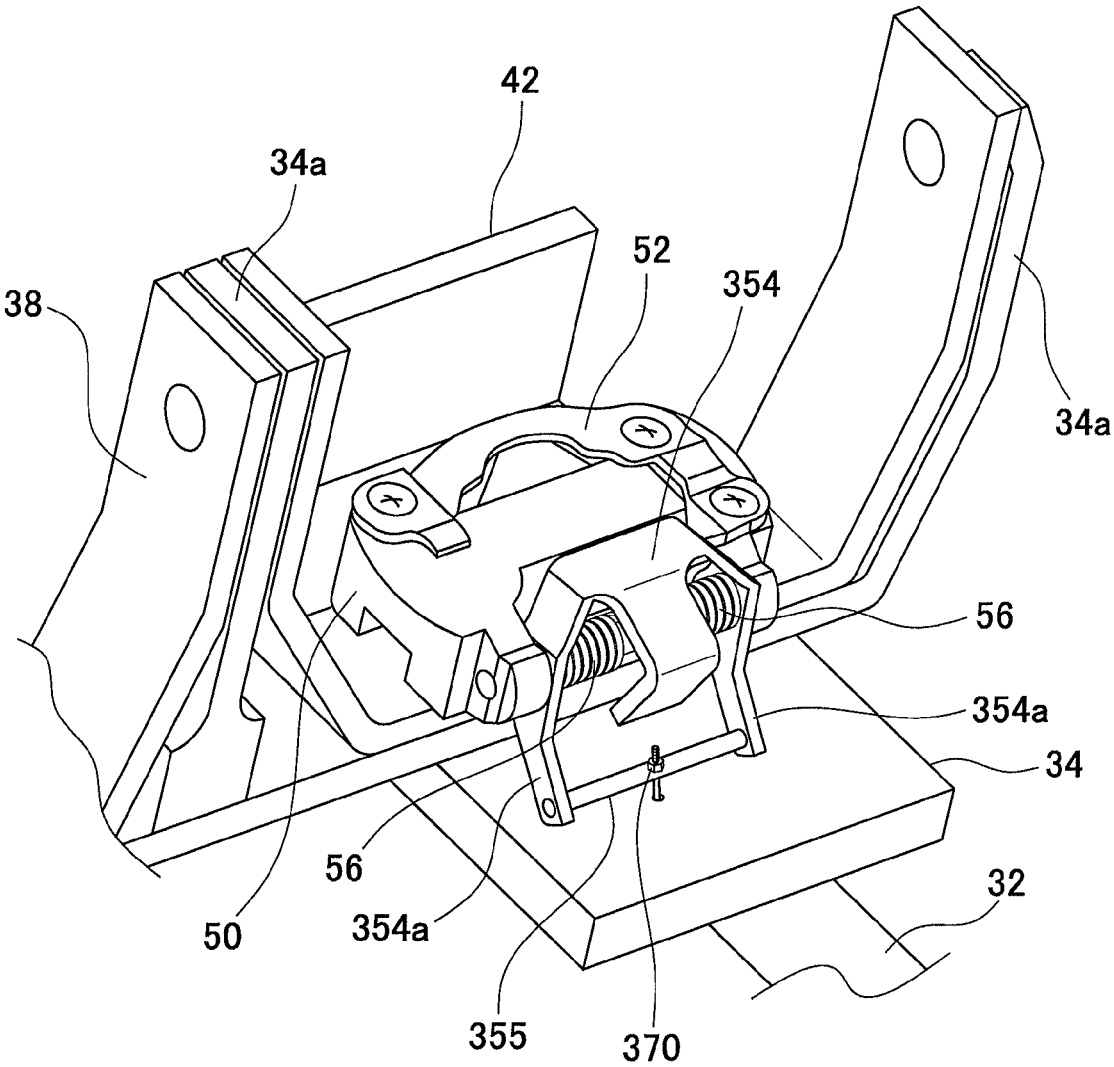
FIG. 24 is a rear perspective view of the shoe attachment member illustrated in FIGS. 21 and 22, with the rear fixing portion in the rest position.

Referring now to FIGS. 14 to 16, a modified shoe attachment member in will now be explained accordance with a second embodiment. In this embodiment, the modified shoe attachment member is identical to the modified shoe attachment member 26 of the first embodiment, except that the rear clamping member 54 (e.g., the movable fixing portion) has been replaced with a rear clamping member 154. In view of the similarity between the first and second embodiments, the parts of the second embodiment that are identical to the parts of the first embodiment will be given the same reference numerals as the parts of the first embodiment. Moreover, the descriptions of the parts of the second embodiment that are identical to the parts of the first embodiment may be omitted for the sake of brevity.

In this embodiment, for each of the shoe attachment member, the support member 24 is provided with a stopper 170, which is a tether in the form of a string, and the rear clamping member 154 is provided with a pair of projections 154*a* with a cross member 155 laterally connecting the projections 154*a* so as to form an integrated projection. The cross member 155 of the integrated projection has a hole 155*a* for securing stopper 170 (e.g., the string type tether). Preferably, the tether 74 of the float 72 is coupled to the cross member 155 of the rear clamping members 154. The stopper 170 (e.g., the string type tether) has a prescribed length permitting pivotal movement of the shoe attachment members without moving the rear clamping member 154 of the shoe attachment member while the shoe attachment member is within the prescribed pivotal rowing range (up to twenty-five degrees), and with the prescribed length of the stopper 170 (e.g., the string type tether) being such that the rear clamping member 154 of the shoe attachment member moves from the shoe retaining position to the shoe releasing position while the shoe attachment member is moved to an extended pivotal position (thirty-four degrees) that is outside of the prescribed pivotal rowing range.

Third Embodiment

Referring now to FIGS. 17 to 20, a modified shoe attachment member in will now be explained accordance with a third embodiment. In this embodiment, the modified shoe attachment member is identical to the modified shoe attachment member 26 of the first embodiment, except that the rear clamping member 54 (e.g., the movable fixing portion) has been replaced with a rear clamping member 254. In view of the similarity between the first and third embodiments, the parts of the third embodiment that are identical to the parts of the first embodiment will be given the same reference numerals as the parts of the first embodiment. Moreover, the descriptions of the parts of the third embodiment that are identical to the parts of the first embodiment may be omitted for the sake of brevity.

In this embodiment, for each of the shoe attachment member, the support member 24 is provided with a stopper 270, which is a tether in the form of a cable, and the rear clamping member 254 is provided with a pair of projections 254*a* with a cross member 255 laterally connecting the projections 254*a* so as to form an integrated projection. The cross member 255 of the integrated projection has a hole 255*a* with a bolt 255*b* for securing stopper 270 (e.g., the cable type tether). Preferably, the tether 74 of the float 72 is coupled to the cross member 255 of the rear clamping members 254. The stopper 270 (e.g., the cable type tether) has a prescribed length permitting pivotal movement of the shoe attachment members without moving the rear clamping member 254 of the shoe attachment member while the shoe attachment member is within the prescribed pivotal rowing range (up to twenty-five degrees), and with the prescribed length of the stopper 270 (e.g., the cable type tether) being such that the rear clamping member 254 of the shoe attachment member moves from the shoe retaining position to the shoe releasing position while the shoe attachment member is moved to an extended pivotal position (thirty-four degrees) that is outside of the prescribed pivotal rowing range.

Fourth Embodiment

Referring now to FIGS. 21 to 24, a modified shoe attachment member in will now be explained accordance with a fourth embodiment. In this embodiment, the modified shoe attachment member is identical to the modified shoe attachment member 26 of the first embodiment, except that the rear clamping member 54 (e.g., the movable fixing portion) has been replaced with a rear clamping member 354. In view of the similarity between the first and fourth embodiments, the parts of the fourth embodiment that are identical to the parts of the first embodiment will be given the same reference numerals as the parts of the first embodiment. Moreover, the descriptions of the parts of the fourth embodiment that are identical to the parts of the first embodiment may be omitted for the sake of brevity.

In this embodiment, for each of the shoe attachment member, the support member 24 is provided with a stopper 370, which is a tether in the form of a rigid rod, and the rear clamping member 354 is provided with a pair of projections 354*a* with a cross member 355 laterally connecting the projections 354*a* so as to form an integrated projection. The cross member 355 can pivot with respect the projections 354*a*. The cross member 355 of the integrated projection has a hole 255*a* with a slide part 370*a* of the stopper 370 (e.g., the rigid rod type tether) disposed in the hole 255*a* of the cross member 355. Preferably, the tether 74 of the float 72 is coupled to the cross member 355 of the rear clamping members 354. The stopper 370 is provided with a first contact part 370*b* at one end of the slide part 370*a* and a second contact part 370*b* at the other end of the slide part 370*a*. The stopper 370 (e.g., the rigid rod type tether) permits pivotal movement of the shoe attachment member without moving the rear clamping member 354 of the shoe attachment member while the shoe attachment member is within the prescribed pivotal rowing range (up to twenty-five degrees), and with the contact parts of the stopper contacting the rear clamping member 354 of the shoe attachment member to move the rear clamping member 354 of the shoe attachment member from the shoe retaining position to the shoe releasing position while the shoe attachment member is moved to an extended pivotal position (thirty-four degrees) that is outside of the prescribed pivotal rowing range.

Fifth Embodiment

Figure 25:
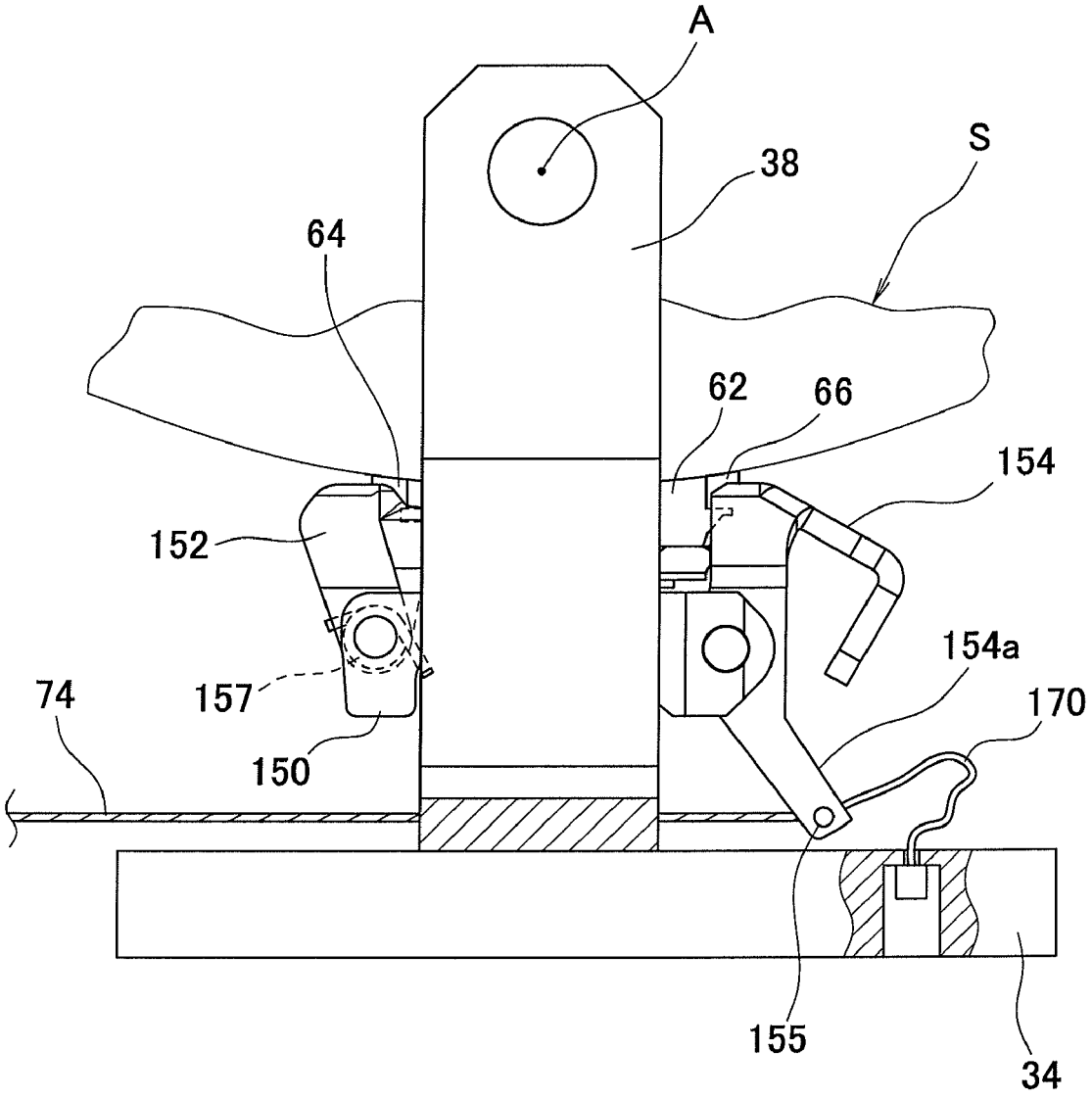
FIG. 25 is an enlarged side view of a shoe attachment member of a foot support assembly in accordance with a fifth embodiment, with the rear fixing portion in the rest position.
Figure 26:
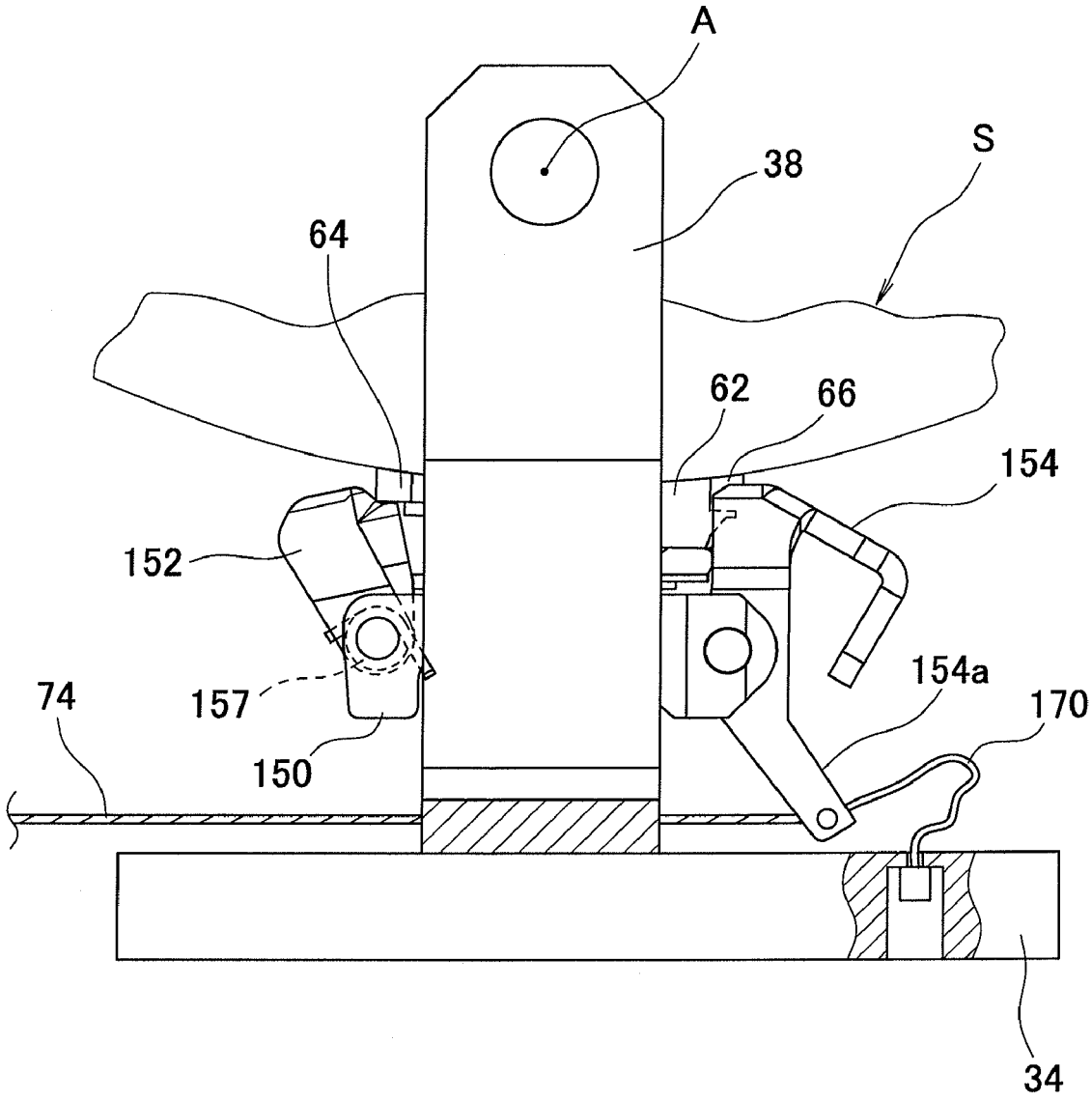
FIG. 26 is an enlarged side view of the shoe attachment member illustrated in FIG. 25, with the front fixing portion pivoted forward by the cleat during attachment of the cleat to the shoe attachment member.

Referring now to FIGS. 25 and 26, a modified shoe attachment member in will now be explained accordance with a fifth embodiment. In this embodiment, the modified shoe attachment member is identical to the modified shoe attachment member 26 of the first embodiment, except that the body member 50 and the front clamping member 52 (e.g., a movable fixing portion) have been replaced with a body member 150 and a front clamping member 152 and the rear clamping member 54 (e.g., the movable fixing portion) has been replaced with the rear clamping member 154 of the second embodiment. In view of the similarity between the prior embodiments and the fifth embodiment, the parts of the fifth embodiment that are identical to the parts of the prior embodiments will be given the same reference numerals as the parts of the first embodiment. Moreover, the descriptions of the parts of the fifth embodiment that are identical to the parts of the prior embodiments may be omitted for the sake of brevity.

In this embodiment, the front clamping member 152 is movably with respect to the base member 50 between a shoe retaining position and a shoe insertion position. The rear clamping member 154 is also movably with respect to the base member 50 between the shoe retaining position and the shoe releasing position as discussed above with respect to the second embodiment. This arrangement allows the rower R to insert the rear end 66 of the one of the cleats 62 beneath the rear clamping member 54 and then step down on the shoe attachment members 26 so that the front end 64 of the cleat 62 will contact a rear edge of the front clamping member 52 to pivot the front clamping member 52 in a forward direction against a biasing force of the biasing member 157. Once the front end 64 of the cleat 62 passes over the rear edge of the front clamping member 52 the biasing force of the biasing member 157 pivots the front clamping member 52 in a rearward direction to grip the front end 64 of the cleat 62.

Sixth Embodiment

Figure 27:
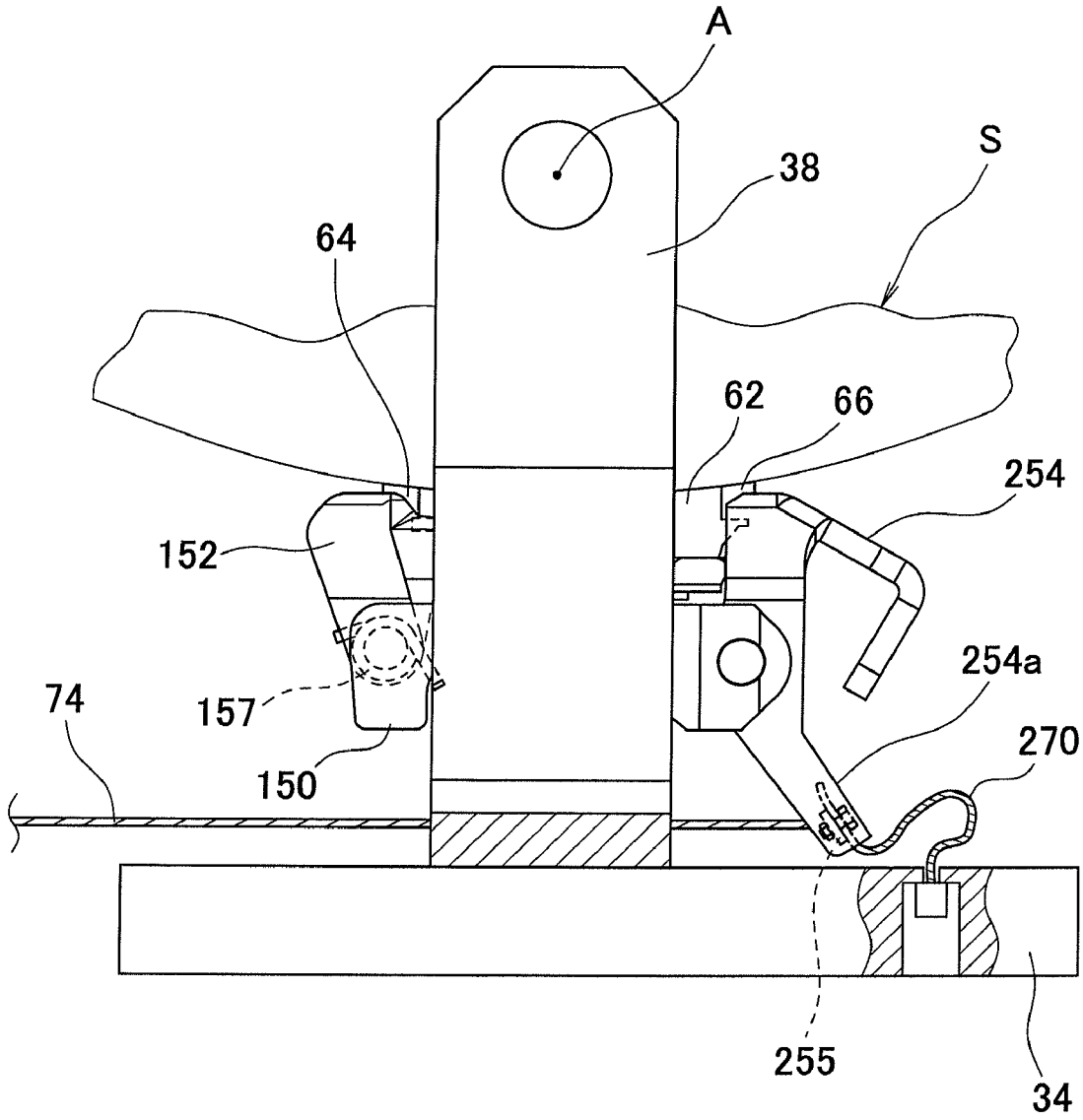
FIG. 27 is an enlarged side view of a shoe attachment member of a foot support assembly in accordance with a sixth embodiment, with the rear fixing portion in the rest position.
Figure 28:
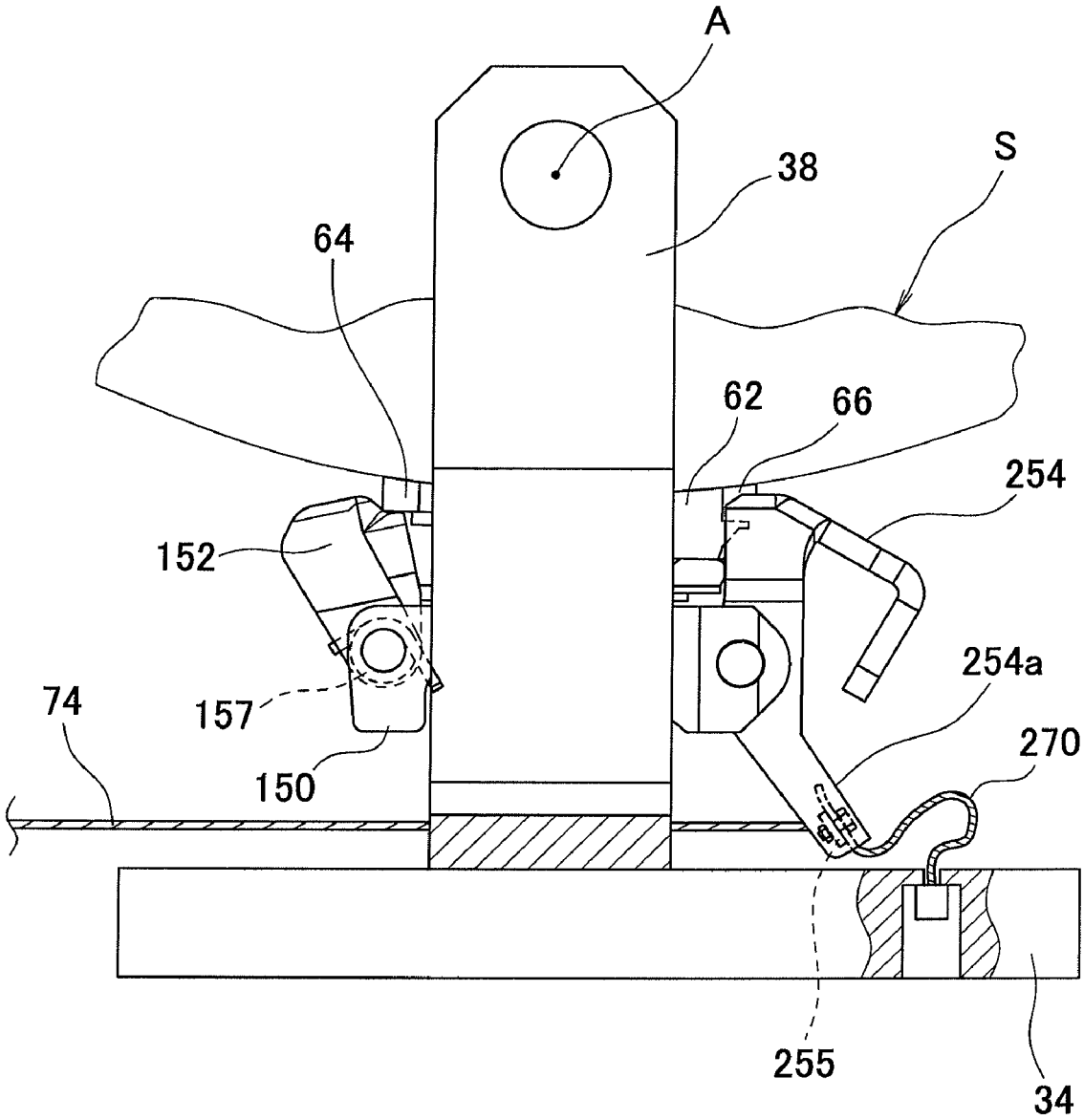
FIG. 28 is an enlarged side view of the shoe attachment member illustrated in FIG. 27, with the front fixing portion pivoted forward by the cleat during attachment of the cleat to the shoe attachment member.

Referring now to FIGS. 27 and 28, a modified shoe attachment member in will now be explained accordance with a sixth embodiment. In this embodiment, the modified shoe attachment member is identical to the modified shoe attachment member of the fifth embodiment, except that the rear clamping member 154 (e.g., the movable fixing portion) has been replaced with the rear clamping member 254 of the third embodiment. In view of the similarity between the prior embodiments and the sixth embodiment, the parts of the sixth embodiment that are identical to the parts of the prior embodiments will be given the same reference numerals as the parts of the prior embodiments. Moreover, the descriptions of the parts of the sixth embodiment that are identical to the parts of the prior embodiments may be omitted for the sake of brevity.

In this embodiment, the front clamping member 152 is movably with respect to the base member 50 between a shoe retaining position and a shoe insertion position as discussed above with respect to the fifth embodiment. The rear clamping member 254 is also movably with respect to the base member 50 between the shoe retaining position and the shoe releasing position as discussed above with respect to the third embodiment. This embodiment combines the benefits of the third and fifth embodiments.

Seventh Embodiment

Figure 29:
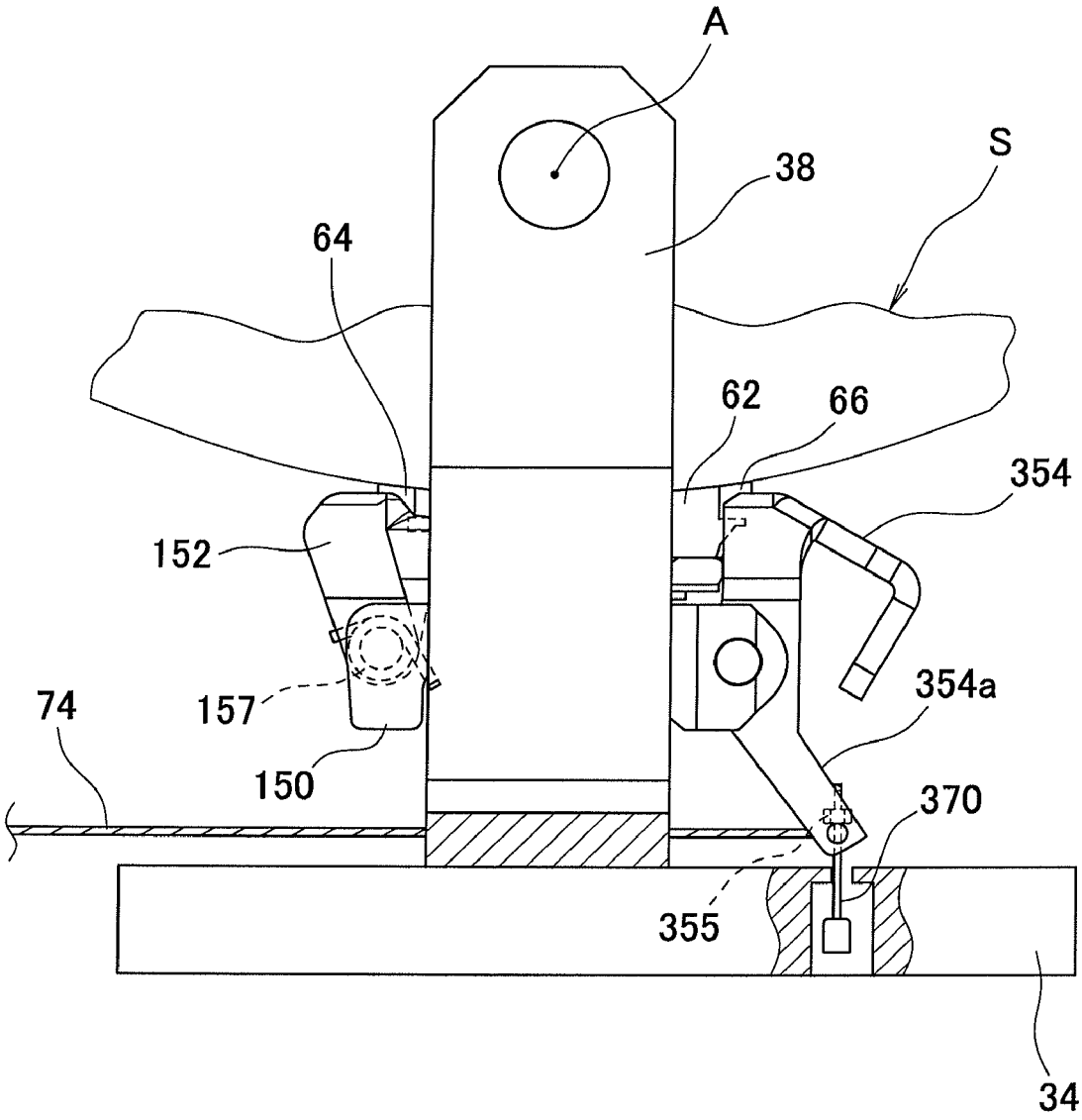
FIG. 29 is an enlarged side view of a shoe attachment member of a foot support assembly in accordance with a seventh embodiment, with the rear fixing portion in the rest position.
Figure 30:
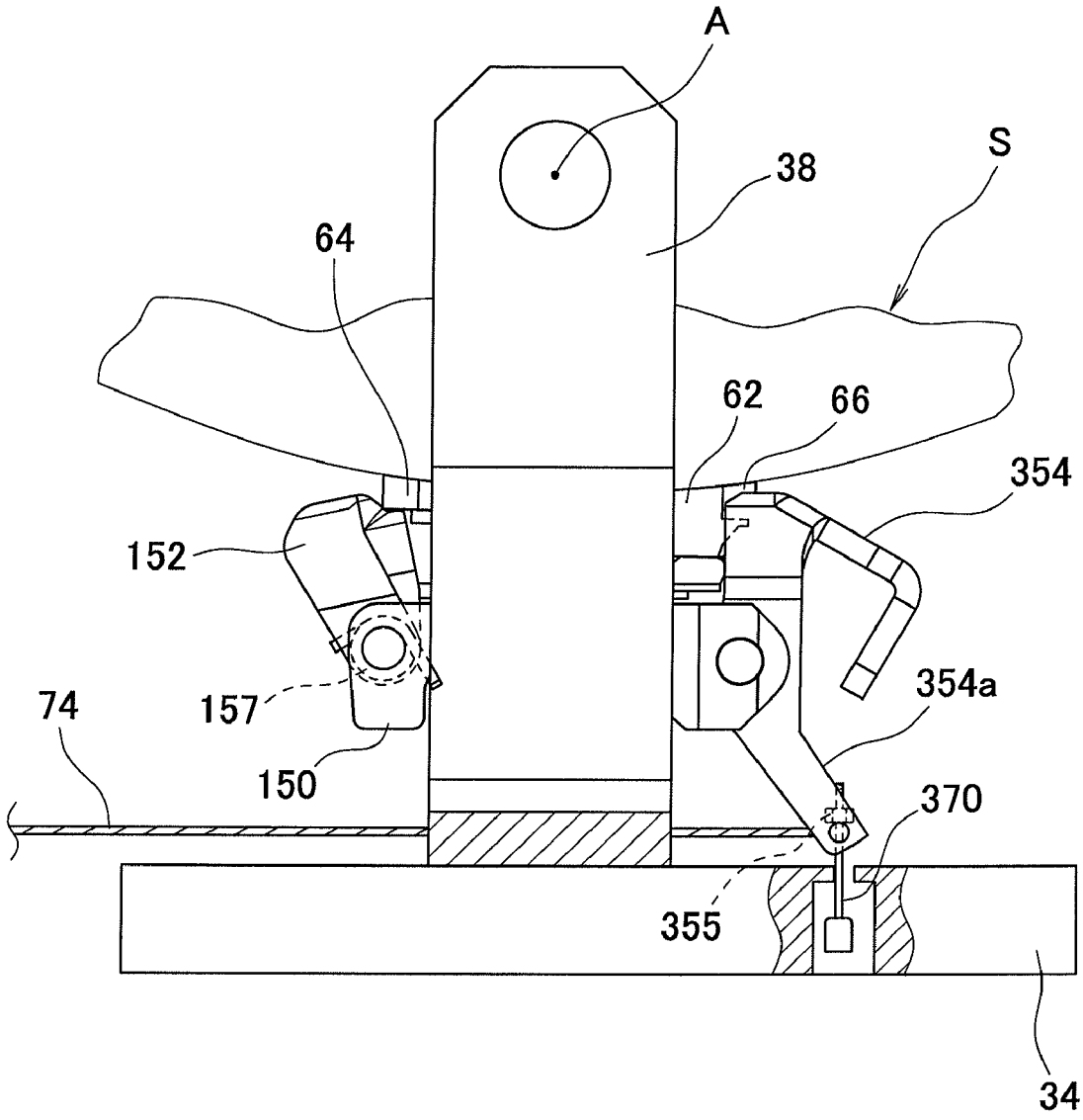
FIG. 30 is an enlarged side view of the shoe attachment member illustrated in FIG. 29, with the front fixing portion pivoted forward by the cleat during attachment of the cleat to the shoe attachment member.
Figure 31:
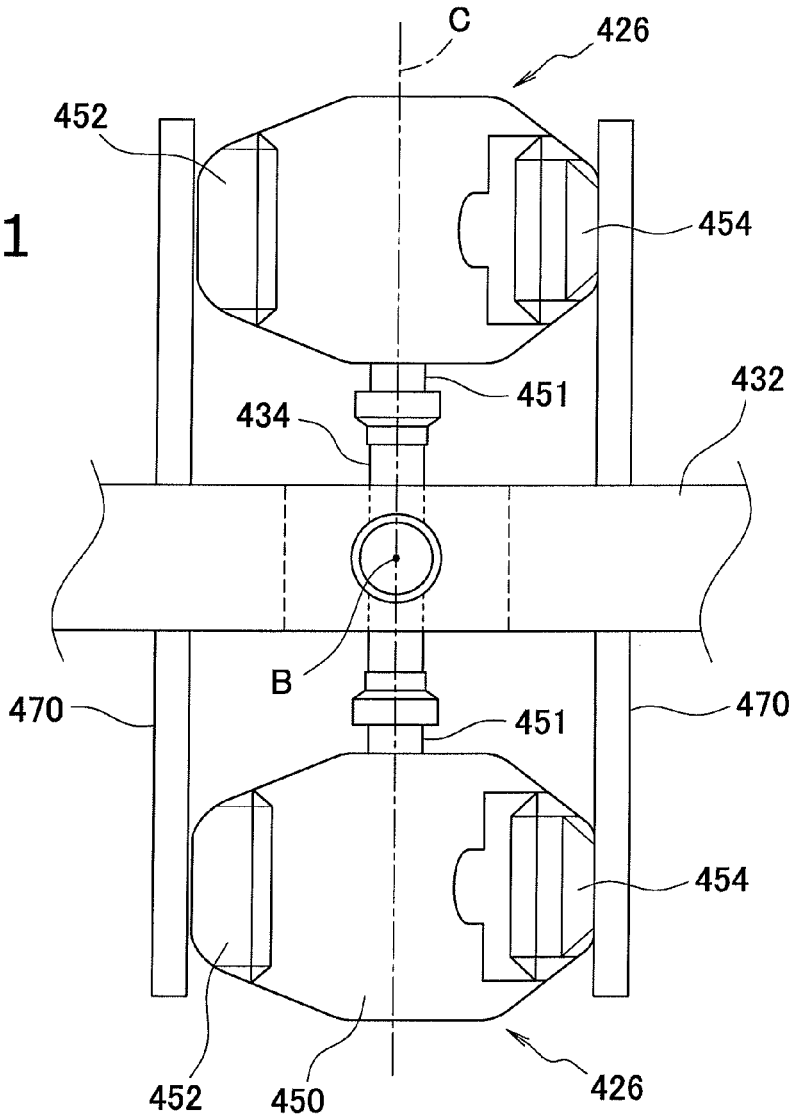
FIG. 31 is a top view of a foot support assembly in accordance with an eighth embodiment, with the shoe attachment members in a normal rowing position.
Figure 32:
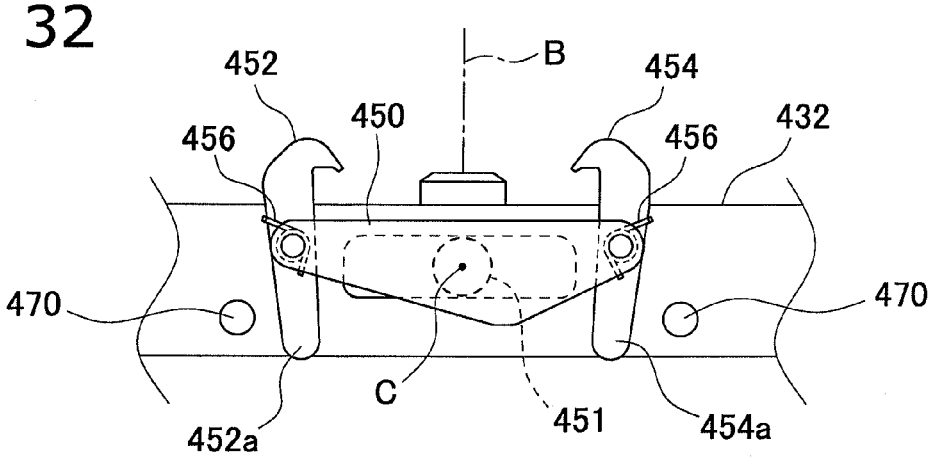
FIG. 32 is a side view of the foot support assembly illustrated in FIG. 31, with the shoe attachment member in the normal rowing position.
Figure 33:
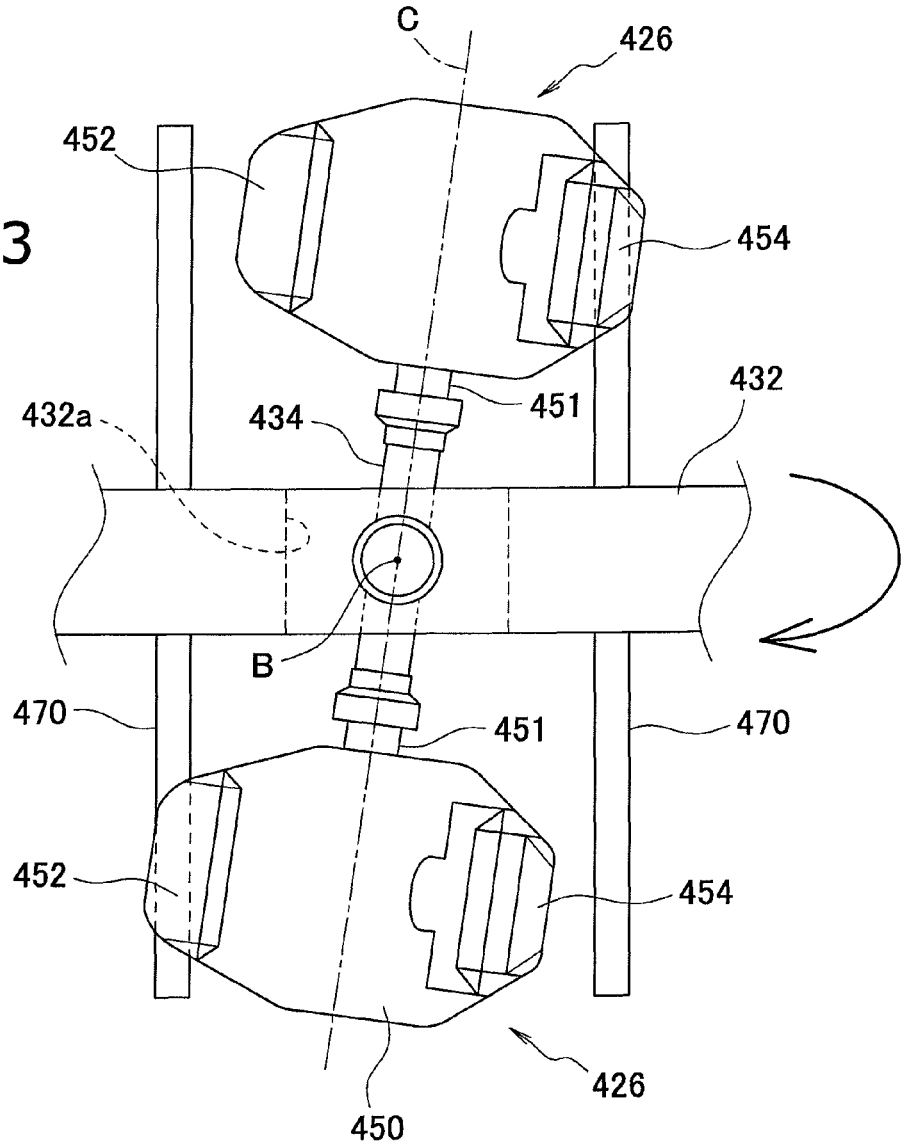
FIG. 33 is a top view of the foot support assembly illustrated in FIGS. 31 and 32, with the shoe attachment members pivoted outside of the normal rowing position to perform a releasing operation.
Figure 34:
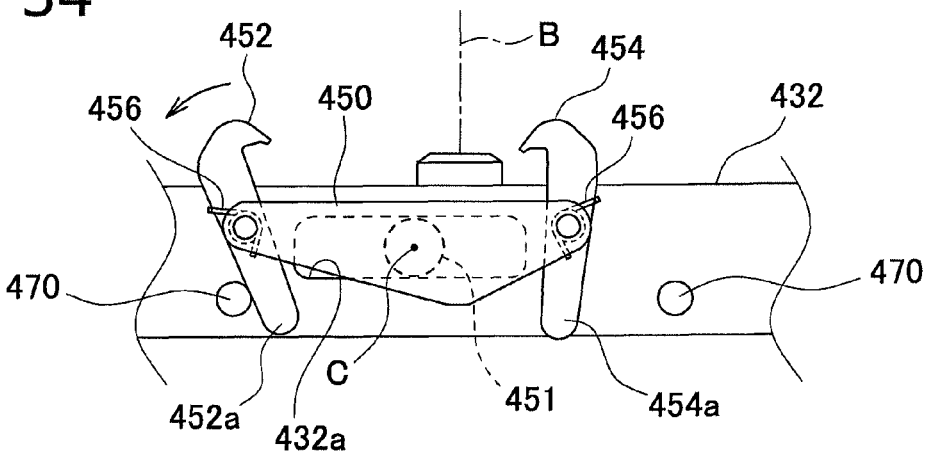
FIG. 34 is a side view of the foot support assembly illustrated in FIGS. 31 to 33, with the shoe attachment members pivoted outside of the normal rowing position to perform a releasing operation.

Referring now to FIGS. 29 and 30, a modified shoe attachment member in will now be explained accordance with a seventh embodiment. In this embodiment, the modified shoe attachment member is identical to the modified shoe attachment member of the fifth embodiment, except that the rear clamping member 154 (e.g., the movable fixing portion) has been replaced with the rear clamping member 354 of the fourth embodiment. In view of the similarity between the prior embodiments and the seventh embodiment, the parts of the seventh embodiment that are identical to the parts of the prior embodiments will be given the same reference numerals as the parts of the prior embodiments. Moreover, the descriptions of the parts of the seventh embodiment that are identical to the parts of the prior embodiments may be omitted for the sake of brevity.

In this embodiment, the front clamping member 152 is movably with respect to the base member 50 between a shoe retaining position and a shoe insertion position as discussed above with respect to the fifth embodiment. The rear clamping member 354 is also movably with respect to the base member 50 between the shoe retaining position and the shoe releasing position as discussed above with respect to the fourth embodiment. This embodiment combines the benefits of the fourth and fifth embodiments.

Eighth Embodiment

Referring now to FIGS. 31 to 34, a modified foot support assembly in will now be explained accordance with an eighth embodiment. In this embodiment, a single inclined bar 432 is mounted at its upper end to the lateral support bar 30 and at its lower end to the lower rail 22*b*. A shoe attachment member 426 is pivotally mounted on each lateral side of the single inclined bar 432 by a crossbar 434 that is pivotally mounted to the single inclined bar 432 to swing about an axis B. Thus, the single inclined bar 432 replaces the inclined U-shaped support bar 32, the swing mounting frame 34 and the pair of U-shaped swinging footrests 38 of the first embodiment, and the shoe attachment members 426 replaces the shoe attachment members 26 of the first embodiment. The single inclined bar 432 is also provided with a pair of stoppers 470 for aiding in the release of the cleats from the shoe attachment members 426. The remaining structures of this embodiment are the same as the first embodiment. In view of the similarity between this embodiment and the prior embodiments, the parts of this embodiment that are identical to the parts of the prior embodiments will be omitted for the sake of brevity.

In this embodiment, the single inclined bar 432 (e.g., a stationary part), the crossbar 434 (e.g., a connecting part) and the stoppers 470 form part of a support member that is adjustably fixed to the row boat 10. Basically, the crossbar 434 has a first end pivotally coupled to the stationary part about a pivot axis B, and a second end coupled to the shoe attachment member 426 to support the shoe attachment member 426 for pivotal movement with respect to the single inclined bar 432 (e.g., a stationary part) about the pivot axis B. In this embodiment, the shoe attachment member 426 also pivots about a pivot axis C that is perpendicular to the pivot axis B. Alternatively, the shoe attachment member 426 can be rigidly fixed to the second end coupled to the shoe attachment member 426 at a prescribed angle as needed and/or desired.

Preferably, the single inclined bar 432 (e.g., a stationary part) is provided with a slot 432*a* that receives the crossbar 434 (e.g., a connecting part) therein. This slot 432*a* allows for the crossbar 434 to pivot about the pivot axis B for a prescribed range of pivotal movement in order for the rower R to perform a releasing operation by pivoting the shoe attachment members 426 with respect to the single inclined bar 432 (e.g., a stationary part) about the pivot axis B.

Each of the shoe attachment members 426 of this illustrated embodiment includes a base member or portion 450 with a spindle 451, a front clamping member 452, a rear clamping member 454, a pair of biasing members 456. The spindle 451 has one end fixed to the crossbar 434 and the other end pivotally supporting the base member 450, similar to a conventional bicycle pedal. Accordingly, the clamping members 452 and 454 constitute fixing portions of the shoe attachment member 426 with the clamping members 452 and 454 being movable fixing portions in this embodiment. The clamping members 452 and 454 are pivotally attached to the base member 450. The biasing members 456 preferably include one or more torsion springs that are disposed on a pivot axle that pivotally mounts the clamping members 452 and 454 to the base member 450.

Each torsion spring of the biasing members 456 has one end operatively engaged with the base member 450 and the other end operatively engaged with one of the clamping members 452 and 454 to urge the clamping members 452 and 454 from the shoe inserting or releasing position to the shoe retaining position. The rear clamping member 454 is disposed rearward of the front clamping member 452 to define a shoe (cleat) receiving area therebetween. The clamping members 452 and 454 have projections 452*a* and 454*a*, respectively, for contacting the stoppers 470, when the rower pivots the shoe attachment members 426 about the axis B. Thus, pivoting the shoe attachment members 426 about the axis B causes one of the projections 452*a* and 454*a* of each of the shoe attachment members 426 to contact one of the stoppers 470 to perform a shoe releasing operation. In other words, in response to the pivotal movement of the shoe attachment members 426 with respect to the single inclined bar 432 (e.g., a stationary part) about the pivot axis B, one of the projections 452*a* and 454*a* of each of the shoe attachment members 426 contacts one of the stoppers 470 to perform a shoe releasing operation. Preferably, the tether 74 of the float 72 is coupled to one of the projections 452*a* and 454*a* of each of the shoe attachment members 426.

Ninth Embodiment

Figure 35:
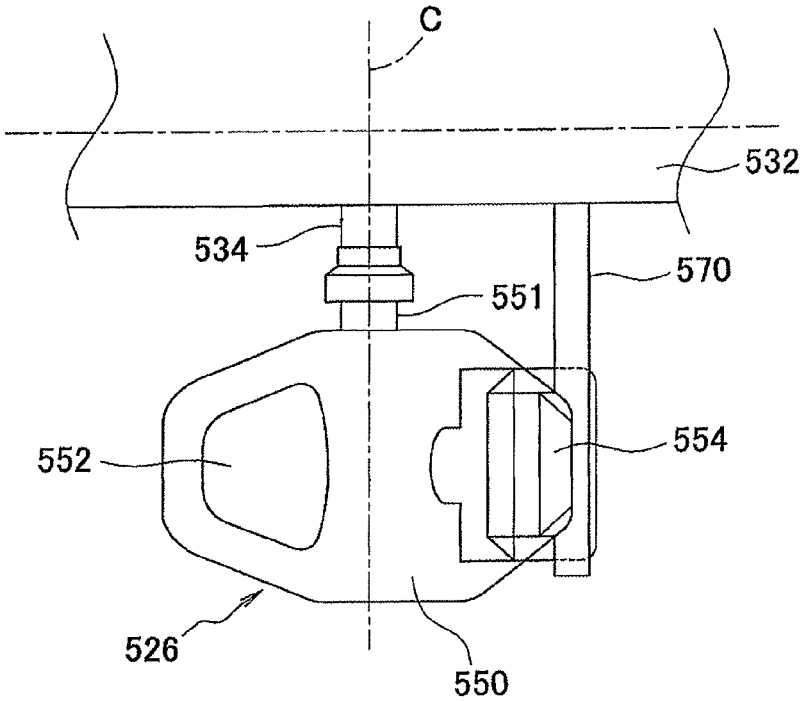
FIG. 35 is a top view of a portion of a foot support assembly in accordance with an ninth embodiment, with the shoe attachment member in a normal rowing position.
Figure 36:
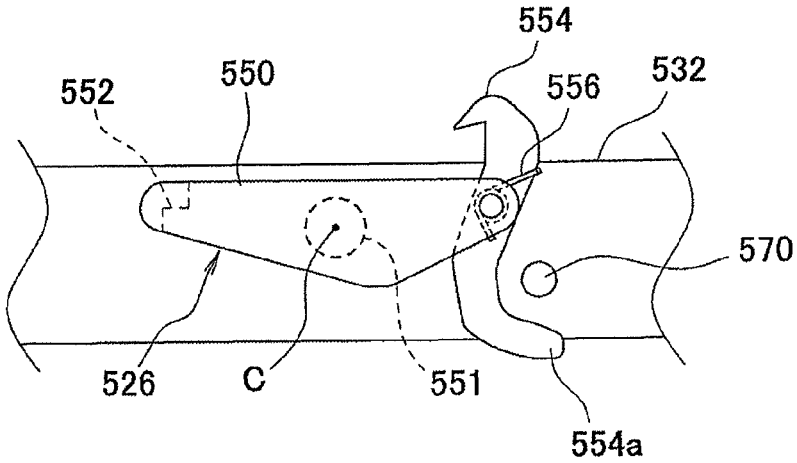
FIG. 36 is a side view of the foot support assembly illustrated in FIG. 35, with the shoe attachment member in the normal rowing position.
Figure 37:
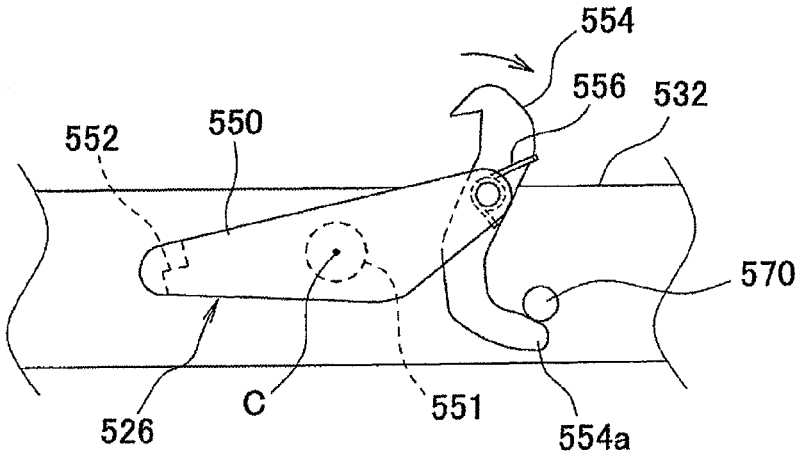
FIG. 37 is a top view of the foot support assembly illustrated in FIGS. 35 and 36, with the shoe attachment member pivoted outside of the normal rowing position to perform a releasing operation.

Referring now to FIGS. 35 to 37, a modified foot support assembly in will now be explained accordance with a ninth embodiment. In this embodiment, similar to the eighth embodiment, the single inclined bar 532 is mounted at its upper end to the lateral support bar 30 and at its lower end to the lower rail 22*b*. A shoe attachment member is pivotally mounted on each lateral side of the single inclined bar 532 by a crossbar that is fixedly mounted to the single inclined bar 532. The shoe attachment members 526 (only one shown) pivot or swing about the axis C. Thus, the single inclined bar 532 replaces the inclined U-shaped support bar 32, the swing mounting frame 34 and the pair of U-shaped swinging footrests 38 of the first embodiment, and the shoe attachment members 526 replaces the shoe attachment members 26 of the first embodiment. The single inclined bar 532 is also provided with a stopper 570 for aiding in the release of the cleats from the shoe attachment members 526. The remaining structures of this embodiment are the same as the first embodiment. In view of the similarity between this embodiment and the prior embodiments, the parts of this embodiment that are identical to the parts of the prior embodiments will be omitted for the sake of brevity.

In this embodiment, the single inclined bar 532 (e.g., a stationary part), the crossbar 534 (e.g., a connecting part) and the stopper 570 form part of a support member that is adjustably fixed to the row boat 10. Basically, the crossbar 534 has a first end rigidly coupled to the single inclined bar 532, and a second end pivotally coupled to the shoe attachment member 526 to support the shoe attachment member 526 for pivotal movement with respect to the crossbar 534 about the pivot axis C.

Each of the shoe attachment members 526 of this illustrated embodiment includes a base member or portion 550 with a spindle 551, a front clamping member 552, a rear clamping member 554 and a biasing member 556. The spindle 551 has one end fixed to the crossbar 534 and the other end pivotally supporting the base member 550, similar to a conventional bicycle pedal. Accordingly, the clamping members 552 and 554 constitute fixing portions of the shoe attachment member 526 with the front clamping member 552 being a non-movable fixing portion and the rear clamping member 554 being a movable fixing portion in this embodiment. The clamping member 554 is pivotally attached to the base member 550. The biasing member 556 preferably includes one or more torsion springs that are disposed on a pivot axle that pivotally mounts the clamping member 554 to the base member 550. The biasing member 556 has one end operatively engaged with the base member 550 and the other end operatively engaged with the rear clamping member 554 to urge the rear clamping member 554 from the shoe releasing position to the shoe retaining position. The rear clamping member 554 is disposed rearward of the front clamping member 552 to define a shoe (cleat) receiving area therebetween. The rear clamping member 554 has a projection 554*a*, respectively, for contacting the stopper 570, when the rower pivots the shoe attachment members 526 about the axis C. Thus, pivoting the shoe attachment members 526 about the axis C causes one of the projections 554*a* of each of the shoe attachment members 526 to contact the stopper 570 to perform a shoe releasing operation. Preferably, the tether 74 of the float 72 is coupled to one of the projection 554*a* of each of the shoe attachment members 526.

Tenth Embodiment

Figure 38:
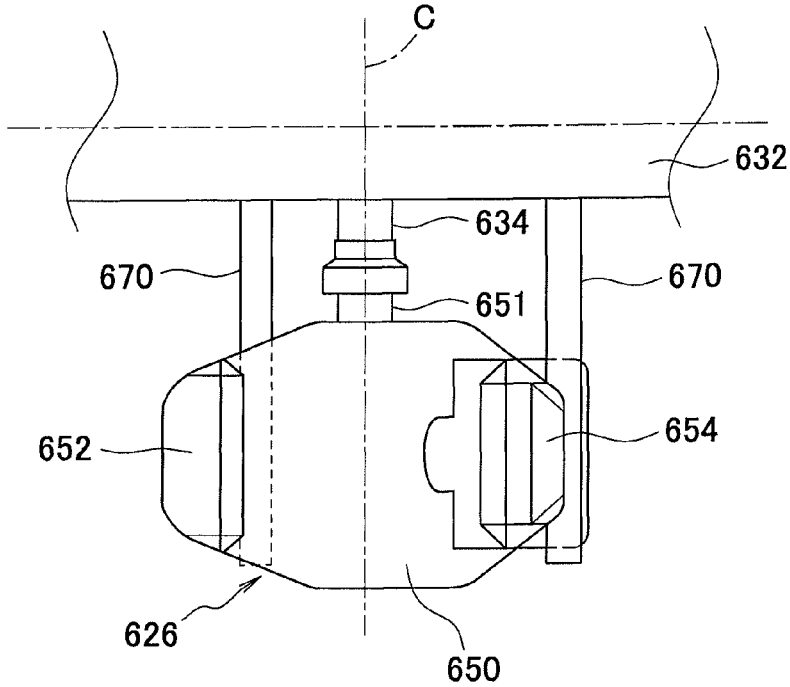
FIG. 38 is a top view of a portion of a foot support assembly in accordance with a tenth embodiment, with the shoe attachment member in a normal rowing position.
Figure 39:
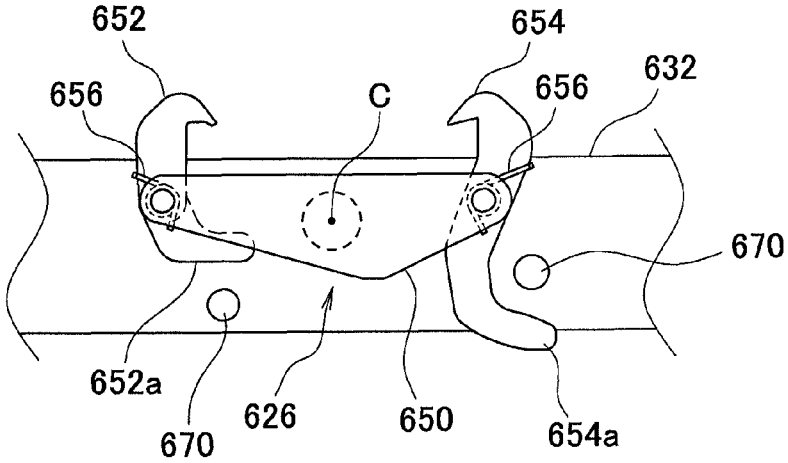
FIG. 39 is a side view of the foot support assembly illustrated in FIG. 38, with the shoe attachment member in the normal rowing position.
Figure 40:
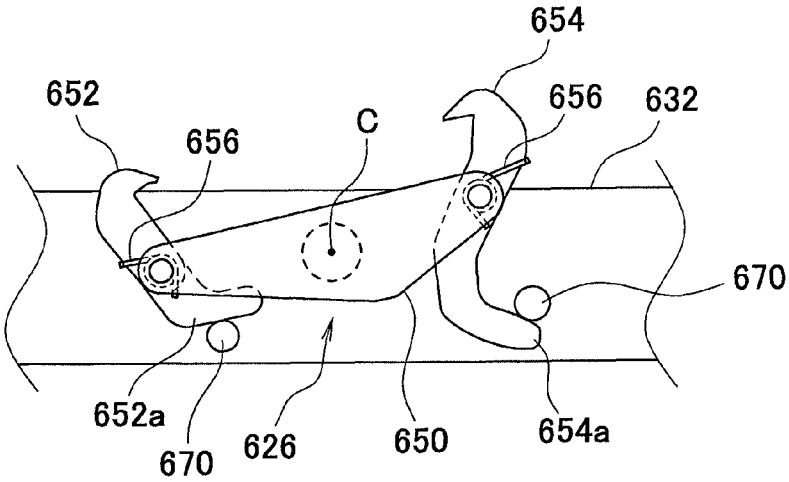
FIG. 40 is a side view of the foot support assembly illustrated in FIGS. 38 and 39, with the shoe attachment member pivoted to perform a releasing operation.

Referring now to FIGS. 38 to 40, a modified foot support assembly in will now be explained accordance with a tenth embodiment. In this embodiment, similar to the eighth and ninth embodiments, the single inclined bar 632 is mounted at its upper end to the lateral support bar 30 and at its lower end to the lower rail 22*b*. A shoe attachment member 626 is pivotally mounted on each lateral side of the single inclined bar 632 by a crossbar that is fixedly mounted to the single inclined bar 432. The shoe attachment members 626 (only one shown) pivot or swing about the axis C. Thus, the single inclined bar 632 replaces the inclined U-shaped support bar 32, the swing mounting frame 34 and the pair of U-shaped swinging footrests 38 of the first embodiment, and the shoe attachment members 626 replaces the shoe attachment members of the first embodiment. The single inclined bar 632 is also provided with a pair of stoppers 670 for aiding in the release of the cleats from the shoe attachment members 626. The remaining structures of this embodiment are the same as the first embodiment. In view of the similarity between this embodiment and the prior embodiments, the parts of this embodiment that are identical to the parts of the prior embodiments will be omitted for the sake of brevity.

In this embodiment, the single inclined bar 632 (e.g., a stationary part), the crossbar 634 (e.g., a connecting part) and the stoppers 670 form part of a support member that is adjustably fixed to the row boat 10. Basically, the crossbar 634 has a first end rigidly coupled to the single inclined bar 632, and a second end pivotally coupled to the shoe attachment member 626 to support the shoe attachment member 626 for pivotal movement with respect to the crossbar 634 about the pivot axis C.

Each of the shoe attachment members 626 of this illustrated embodiment includes a base member or portion 650 with a spindle 651, a front clamping member 652, a rear clamping member 654 and a pair of biasing member 656. The spindle 651 has one end fixed to the crossbar 634 and the other end pivotally supporting the base member 650, similar to a conventional bicycle pedal. Accordingly, the clamping members 652 and 654 constitute movable fixing portions of the shoe attachment member 626 with in this embodiment. The clamping members 652 and 654 are pivotally attached to the base member 650. The biasing members 656 preferably include one or more torsion springs that are disposed on pivot axles that pivotally mount the clamping members 652 and 654 to the base member 650. The biasing members 656 have one end operatively engaged with the base member 650 and the other end operatively engaged with one of the clamping members 652 and 654 to urge the clamping members 652 and 654 from the shoe releasing position to the shoe retaining position. The rear clamping member 654 is disposed rearward of the front clamping member 652 to define a shoe (cleat) receiving area therebetween. The clamping members 652 and 654 have projections 652*a* and 654*a*, respectively, for contacting the stoppers 670, when the rower pivots the shoe attachment members 626 about the axis C. Thus, pivoting the shoe attachment members 626 about the axis C causes one of the projections 652*a* and 654*a* of each of the shoe attachment members 626 to contact the stoppers 670 to perform a shoe releasing operation. Preferably, the tether 74 of the float 72 is coupled to one of the projections 652*a* and 654*a* of each of the shoe attachment members 626.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. As used herein to describe the present invention, the following directional terms "above, downward, vertical, horizontal, below and transverse" as well as any other similar directional terms refer to those directions of a rowing boat equipped with the present invention. Accordingly, these terms, as utilized to describe the present invention should be interpreted relative to a rowing boat equipped with the present invention as used in the normal rowing position. Finally, terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A rowing boat foot support assembly comprising:

a support member configured to be coupled to a rowing boat;

a shoe attachment member pivotally supported on the support member, the shoe attachment member including a base portion and a movable fixing portion that is movably arranged with respect to the base portion between a shoe retaining position and a shoe releasing position; and a release trigger mechanism provided between the support member and the movable fixing portion to move the movable fixing portion from the shoe retaining position to the shoe releasing position.

2. The rowing boat foot support assembly according to claim 1, wherein the movable fixing portion is pivotally arranged with respect to the base portion.

3. The rowing boat foot support assembly according to claim 1, further comprising a float member operatively coupled to the movable fixing portion by a connecting member that is arranged to move the movable fixing portion from the shoe retaining position to the shoe releasing position in response to a pulling movement of the float member with respect to the movable fixing portion.

4. The rowing boat foot support assembly according to claim 1, wherein the shoe attachment member is pivotally supported on the support member about a pivot axis extending in a transverse direction to a longitudinal axis of the rowing boat so that the shoe attachment member pivots in a prescribed pivotal rowing range during a rowing; and the release trigger mechanism includes a stopper coupled to the support member and a projection coupled to the movable fixing portion of the shoe attachment member to engage the stopper in response to the pivotal movement of the shoe attachment member outside of the prescribed pivotal rowing range.

5. The rowing boat foot support assembly according to claim 4, wherein the stopper is fixed to the support member and the projection is fixed to the movable fixing portion of the shoe attachment member, with a free space disposed between the stopper and the projection while the shoe attachment member is within the prescribed pivotal rowing range, and with the stopper and the projection contacting while the shoe attachment member is in an extended pivotal position that is outside of the prescribed pivotal rowing range.

6. The rowing boat foot support assembly according to claim 4, wherein the stopper is a tether that is fixed between the support member and the projection, with the tether having a length permitting pivotal movement of the shoe attachment member without moving the movable fixing portion of the shoe attachment member while the shoe attachment member is within the prescribed pivotal rowing range, and with the length of the tether being such that the movable fixing portion of the shoe attachment member moves from the shoe retaining position to the shoe releasing position while the shoe attachment member is moved to an extended pivotal position that is outside of the prescribed pivotal rowing range.

7. The rowing boat foot support assembly according to claim 4, wherein the projection includes a hole with a slide part of the stopper slidably disposed in the hole of the projection to permit pivotal movement of the shoe attachment member without moving the movable fixing portion of the shoe attachment member while the shoe attachment member is within the prescribed pivotal rowing range, and with a contact part of the stopper contacting the movable fixing portion of the shoe attachment member to move the movable fixing portion of the shoe attachment member from the shoe retaining position to the shoe releasing position while the shoe attachment member is moved to an extended pivotal position that is outside of the prescribed pivotal rowing range.

8. The rowing boat foot support assembly according to claim 1, wherein the shoe attachment member further includes a front fixing portion disposed on the base portion, with the movable fixing portion being disposed rearward of the front fixing portion to define a shoe receiving area therebetween.

9. The rowing boat foot support assembly according to claim 8, wherein the front fixing portion is non-movably with respect to the base portion.

10. The rowing boat foot support assembly according to claim 8, wherein the front fixing portion is movably with respect to the base portion.

11. The rowing boat foot support assembly according to claim 1, wherein the shoe attachment member is pivotally supported on the support member about a pivot axis extending in a transverse direction to a longitudinal axis of the rowing boat so that the shoe attachment member pivots in a prescribed pivotal rowing range during a rowing.

12. The rowing boat foot support assembly according to claim 1, wherein the support member further includes a stationary part, a connecting part having a first end pivotally coupled to the stationary part about a pivot axis, and a stopper coupled to the stationary part, the connecting member having a second end coupled to the shoe attachment member to support the shoe attachment member for pivotal movement with respect to the stationary part about the pivot axis; and the movable fixing portion of the shoe attachment member includes a projection that engages the stopper in response to the pivotal movement of the shoe attachment member with respect to the stationary part about the pivot axis.

13. A rowing boat foot support assembly comprising:

a support member configured to be coupled to a rowing boat; and a shoe attachment member supported on the support member, the shoe attachment member including a base portion, a movably front fixing portion and a movably rear fixing portion, with the front fixing portion being movably with respect to the base portion between a shoe retaining position and a shoe insertion position, and the rear shoe fixing portion being movably with respect to the base portion between a shoe retaining position and a shoe releasing position, wherein the shoe attachment member is pivotally supported on the support member about a pivot axis extending in a transverse direction to a longitudinal axis of the rowing boat so that the shoe attachment member pivots in a prescribed pivotal rowing range during a rowing;

the support member includes a stopper; and the rear fixing portion of the shoe attachment member includes a projection that engages the stopper in response to the pivotal movement of the shoe attachment member outside of the prescribed pivotal rowing range.

14. The rowing boat foot support assembly according to claim 13, wherein the front and rear fixing portions are pivotally arranged with respect to the base portion.

15. The rowing boat foot support assembly according to claim 13, further comprising a float member operatively coupled to the rear fixing portion by a connecting member that is arranged to move the rear fixing portion from the shoe retaining position to the shoe releasing position in response to a pulling movement of the float member with respect to the rear fixing portion.

16. The rowing boat foot support assembly according to claim 13, wherein the stopper is fixed to the support member and the projection is fixed to the rear fixing portion of the shoe attachment member, with a free space disposed between the stopper and the projection while the shoe attachment member is within the prescribed pivotal rowing range, and with the stopper and the projection contacting while the shoe attachment member is in an extended pivotal position that is outside of the prescribed pivotal rowing range.

17. The rowing boat foot support assembly according to claim 13, wherein the stopper is a tether that is fixed between the support member and the projection, with the tether having a length permitting pivotal movement of the shoe attachment member without moving the movable fixing portion of the shoe attachment member while the shoe attachment member is within the prescribed pivotal rowing range, and with the length of the tether being such that the rear fixing portion of the shoe attachment member moves from the shoe retaining position to the shoe releasing position while the shoe attachment member is moved to an extended pivotal position that is outside of the prescribed pivotal rowing range.

18. The rowing boat foot support assembly according to claim 13, wherein the projection includes a hole with a slide part of the stopper slidably disposed in the hole of the projection to permit pivotal movement of the shoe attachment member without moving the rear fixing portion of the shoe attachment member while the shoe attachment member is within the prescribed pivotal rowing range, and with a contact part of the stopper contacting the rear fixing portion of the shoe attachment member to move the rear fixing portion of the shoe attachment member from the shoe retaining position to the shoe releasing position while the shoe attachment member is moved to an extended pivotal position that is outside of the prescribed pivotal rowing range.

19. The rowing boat foot support assembly according to claim 13, wherein the shoe attachment member is pivotally supported on the support member about a pivot axis extending in a transverse direction to a longitudinal axis of the rowing boat so that the shoe attachment member pivots in a prescribed pivotal rowing range during a rowing.

20. The rowing boat foot support assembly according to claim 13, wherein the support member further includes a stationary part, a connecting part having a first end pivotally coupled to the stationary part about a pivot axis, and a stopper coupled to the stationary part, the connecting member having a second end coupled to the shoe attachment member to support the shoe attachment member for pivotal movement with respect to the stationary part about the pivot axis; and the movable fixing portion of the shoe attachment member includes a projection that engages the stopper in response to the pivotal movement of the shoe attachment member with respect to the stationary part about the pivot axis.

21. A rowing boat foot support assembly comprising:

a support member configured to be coupled to a rowing boat;

a shoe attachment member supported on the support member, the shoe attachment member including a base portion and a movable fixing portion that is movably arranged with respect to the base portion between a shoe retaining position and a shoe releasing position; and a float member operatively coupled to the movable fixing portion by a connecting member that is arranged to move the movable fixing portion from the shoe retaining position to the shoe releasing position.

22. The rowing boat foot support assembly according to claim 21, wherein the connecting member is connected between the movable fixing portion and the float member so that a pulling movement of the float member with respect to the movable fixing portion causes the movable fixing portion to move from the shoe retaining position to the shoe releasing position.

23. The rowing boat foot support assembly according to claim 21, wherein the connecting member is a tether.

24. The rowing boat foot support assembly according to claim 21, wherein the movable fixing portion is pivotally arranged with respect to the base portion.

25. The rowing boat foot support assembly according to claim 21, wherein the shoe attachment member is pivotally supported on the support member about a pivot axis extending in a transverse direction to a longitudinal axis of the rowing boat so that the shoe attachment member pivots in a prescribed pivotal rowing range during a rowing;

the support member includes a stopper; and the movable fixing portion of the shoe attachment member includes a projection that engages the stopper in response to the pivotal movement of the shoe attachment member outside of the prescribed pivotal rowing range.

26. The rowing boat foot support assembly according to claim 25, wherein the stopper is fixed to the support member and the projection is fixed to the movable fixing portion of the shoe attachment member, with a free space disposed between the stopper and the projection while the shoe attachment member is within the prescribed pivotal rowing range, and with the stopper and the projection contacting while the shoe attachment member is in an extended pivotal position that is outside of the prescribed pivotal rowing range.

27. The rowing boat foot support assembly according to claim 25, wherein the stopper is a tether that is fixed between the support member and the projection, with the tether having a length permitting pivotal movement of the shoe attachment member without moving the movable fixing portion of the shoe attachment member while the shoe attachment member is within the prescribed pivotal rowing range, and with the length of the tether being such that the movable fixing portion of the shoe attachment member moves from the shoe retaining position to the shoe releasing position while the shoe attachment member is moved to an extended pivotal position that is outside of the prescribed pivotal rowing range.

28. The rowing boat foot support assembly according to claim 25, wherein the projection includes a hole with a slide part of the stopper slidably disposed in the hole of the projection to permit pivotal movement of the shoe attachment member without moving the movable fixing portion of the shoe attachment member while the shoe attachment member is within the prescribed pivotal rowing range, and with a contact part of the stopper contacting the movable fixing portion of the shoe attachment member to move the movable fixing portion of the shoe attachment member from the shoe retaining position to the shoe releasing position while the shoe attachment member is moved to an extended pivotal position that is outside of the prescribed pivotal rowing range.

29. The rowing boat foot support assembly according to claim 25, wherein the float member is connected to a hole formed in the projection of the movable fixing portion.

30. The rowing boat foot support assembly according to claim 21, wherein the shoe attachment member further includes a front fixing portion disposed on the base portion, with the movable fixing portion being disposed rearward of the front fixing portion to define a shoe receiving area therebetween.

31. The rowing boat foot support assembly according to claim 30, wherein the front fixing portion is non-movably with respect to the base portion.

32. The rowing boat foot support assembly according to claim 31, wherein the front fixing portion is movably with respect to the base portion.

33. The rowing boat foot support assembly according to claim 25, wherein the shoe attachment member is pivotally supported on the support member about a pivot axis extending in a transverse direction to a longitudinal axis of the rowing boat so that the shoe attachment member pivots in a prescribed pivotal rowing range during a rowing.

34. The rowing boat foot support assembly according to claim 25, wherein the support member further includes a stationary part, a connecting part having a first end pivotally coupled to the stationary part about a pivot axis, and a stopper coupled to the stationary part, the connecting member having a second end coupled to the shoe attachment member to support the shoe attachment member for pivotal movement with respect to the stationary part about the pivot axis; and the movable fixing portion of the shoe attachment member includes a projection that engages the stopper in response to the pivotal movement of the shoe attachment member with respect to the stationary part about the pivot axis.

35. A rowing boat foot support assembly comprising:

a support member configured to be coupled to a rowing boat;

a shoe attachment member supported on the support member, the shoe attachment member including a base portion, a movably front fixing portion and a movably rear fixing portion, with the front fixing portion being movably with respect to the base portion between a shoe retaining position and a shoe insertion position, and the rear shoe fixing portion being movably with respect to the base portion between a shoe retaining position and a shoe releasing position; and a float member operatively coupled to the rear fixing portion by a connecting member that is arranged to move the rear fixing portion from the shoe retaining position to the shoe releasing position in response to a pulling movement of the float member with respect to the rear fixing portion.

* * * * *